US008363880B2

(12) United States Patent
Takewa

(10) Patent No.: US 8,363,880 B2
(45) Date of Patent: Jan. 29, 2013

(54) SPEAKER AND ELECTRONIC DEVICE INCLUDING THE SAME

(75) Inventor: Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 152 days.

(21) Appl. No.: 13/050,124

(22) Filed: Mar. 17, 2011

(65) Prior Publication Data

US 2011/0235849 A1 Sep. 29, 2011

(30) Foreign Application Priority Data

Mar. 24, 2010 (JP) ..... 2010-068890

(51) Int. Cl.
*H04R 1/00* (2006.01)
*H04R 9/06* (2006.01)
*H04R 11/02* (2006.01)

(52) U.S. Cl. ..... 381/412; 381/431

(58) Field of Classification Search ..... 381/361, 381/386, 396, 398, 401, 403, 405, 407, 412, 381/419, 423, 431, 433; 181/173, 198, 199
See application file for complete search history.

(56) References Cited

U.S. PATENT DOCUMENTS 4,322,584 A * 3/1982 Shimada et al. ..... 381/431
5,664,024 A * 9/1997 Furuta et al. ..... 381/412
5,862,242 A * 1/1999 Takewa et al. ..... 381/398
6,714,655 B2 * 3/2004 Iwasa et al. ..... 381/396
6,859,544 B2 * 2/2005 Kato et al. ..... 381/412
2003/0068063 A1 4/2003 Usuki et al.
2005/0105758 A1 5/2005 Tsuda
2009/0003644 A1 1/2009 Furuya

FOREIGN PATENT DOCUMENTS

JP 2003-274486 9/2003
JP 2004-032659 1/2004
JP 2009-010806 1/2009

* cited by examiner

*Primary Examiner* — Tuan D Nguyen
(74) *Attorney, Agent, or Firm* — Wenderoth, Lind & Ponack, LLP.

(57) ABSTRACT

A speaker includes a diaphragm 11, edges 12, at least one voice coil bobbin 14, a voice coil 15, and a magnetic circuit 21. The diaphragm 11 is a long flat plate. The edges 12 at ends of the diaphragm 11 in a longer-side direction support the diaphragm 11 to vibrate. The voice coil bobbin 14 has a substantially square pillar shape with a height more than twice as vibrational amplitude of the diaphragm 11, includes an opening having a periphery connected directly to the diaphragm 11, and supports the diaphragm 11 to transmit vibration to it. The voice coil 15 is wound around an outer periphery of the voice coil bobbin 14 substantially at center in a height direction. The magnetic circuit 12 drives the voice coil 15. The long speaker is unlikely to cause breakeup resonance, and has smooth frequency characteristics to offer good sound quality.

11 Claims, 24 Drawing Sheets

SPEAKER AND ELECTRONIC DEVICE INCLUDING THE SAME

BACKGROUND OF THE INVENTION (1) Field of the Invention

The present invention relates to speakers and electronic devices including the same, and more particularly to a slim and thin speaker and an electronic device including the same.

(2) Description of the Related Art

In recent years, with the popularity of high-definition and wide-screen television and the like, wide and large television screens have been widely used. On the other hand, there is a demand for narrow and thin television sets to satisfy the housing situations in Japan.

Speaker drivers (hereinafter, referred to simply as "speakers") used in a television set are generally provided at both sides of a TV display screen such as cathode-ray tube (CRT) display. The speakers therefore results in increase of a width of the television set. In order to address the above drawback, TV speakers have been slim in shape, for example, having a horn or elliptic shape (see Patent Reference 1: Japanese Unexamined Patent Application Publication No. 2004-32659). Furthermore, with the increase of width of TV screens such as CRT displays, speakers are demanded to be further narrower and to have higher sound quality according to higher image quality of the screen. Moreover, thin television sets having a plasma display or a liquid crystal display are increased. Therefore, thinner speakers are further demanded.

The following describes the conventional slim speaker disclosed in Patent Reference 1 with reference to figures. FIGS. 24A to 24C are views of the conventional slim speaker. FIG. 24A is a plane view of the conventional slim speaker. FIG. 24B is a cross-sectional view of the conventional slim speaker taken along line C-C' (in other words, along a longer side of the speaker, hereinafter, referred to also as "along the longer-side direction") of FIG. 24A. FIG. 24C is a cross-sectional view of the conventional slim speaker taken along line O-O' (in other words, along a shorter side of the speaker, hereinafter, referred to also as "along the shorter-side direction") of FIG. 24A.

The slim speaker shown in FIGS. 24A to 24C includes a magnet 801, a plate 802, a yoke 803, a frame 804, a voice coil bobbin 805, a voice coil 806, a damper 807, a diaphragm 809, a dust cap 810, and an edge 811. In this slim speaker, there is a magnetic gap 808 between: the magnet 801 and the plate 802; and the yoke 803.

The voice coil 806 is a conductor wire made of copper, aluminium, or the like. The voice coil 806 is fixed to the voice coil bobbin 805 that is cylindrical in shape. In other words, the voice coil bobbin 805 suspends the voice coil 806 in the magnetic gap 808.

The voice coil bobbin 805 is connected to the frame 804 via the damper 807. Furthermore, the voice coil bobbin 805 is adherently fixed to the side of the diaphragm 809 which is opposite to the side fixed with the voice coil 806.

The diaphragm 809 is in a shape of an ellipse or a substantially ellipse. A dust cap 810 is adherent to the center of the diaphragm 809. A cross-sectional surface of the dust cap 810 is substantially semicircular in shape.

The edge 811 is circular in shape. A cross section of the edge 811 is a semicircle. The inner periphery of the edge 811 is fixed to the outer periphery of the diaphragm 809. The outer periphery of the edge 811 is adherent to the frame 804.

Next, the description is given for driving of the speaker having the above-described parts as shown in FIG. 24A to 24C. First, electric current (current) flows into the voice coil 806. The current flowing in the voice coil 806 and a magnetic field around the voice coil 806 allows the voice coil bobbin 805 to execute pistonic motion. Thereby, the diaphragm 809 moves back and forth (vibrates) by the pistonic motion. As a result, the diaphragm 809 produces sound waves.

FIG. 25 is a graph plotting frequency characteristics regarding a reproduction sound pressure level of the conventional speaker disclosed in Patent Reference 1. In FIG. 25, a vertical axis represents a reproduction sound pressure level and a horizontal axis represents a drive frequency, in the situation where electric power of 1 W is applied to the speaker. The reproduction sound pressure level is measured by a microphone far by 1 m from a front of the speaker on the center axis of the speaker.

However, the conventional speaker has the following problem. More specifically, the speaker shown in FIGS. 24A and 24C employs a driving method of driving the center portion of the slim diaphragm 809. Therefore, breakeup resonance is likely to occur along a longer-side direction of the diaphragm 809. As a result, the frequency characteristics regarding reproduction sound pressure level have peaks and dips in middle and high ranges. In other words, the above-described conventional speaker causes breakeup resonance along the longer-side direction of the speaker and thereby deteriorates sound quality. As seen in FIG. 25, the problem is apparent from noticeable dips (peak/dip) closer to driving frequency of 2 kHz (A in FIG. 25), driving frequency of 3 kHz (B in FIG. 25), and driving frequency of 5 kHz (C in FIG. 25).

SUMMARY OF THE INVENTION

Thus, the present invention addresses the above-described problem of the conventional technique. It is an object of the present invention to provide a speaker which has a long structure but is unlikely to cause breakeup resonance, and is thereby capable of having smooth frequency characteristics to offer good sound quality. It is another object of the present invention to provide an electronic device including the speaker.

In accordance with a first aspect of the present invention for achieving the objects, there is provided A speaker including: a diaphragm that is a long flat plate; an edge disposed at an end of the diaphragm viewed in a longer-side direction of the speaker, the edge supporting the diaphragm to allow the diaphragm to vibrate; at least one voice coil bobbin in a shape of a substantially square pillar having a height that is equal to or more than twice as a vibrational amplitude of the diaphragm, the at least one voice coil bobbin including an opening having a periphery connected directly to the diaphragm, and the at least one voice coil bobbin supporting the diaphragm to transmit vibration to the diaphragm; a voice coil wound around an outer periphery of the at least one voice coil bobbin substantially at center in a height direction of the at least one voice coil bobbin; and a magnetic circuit arranged to drive the voice coil.

With the above structure, the edges are not provided to the ends of the diaphragm viewed in the shorter-side direction of the diaphragm. Thereby, it is possible to provide a quite slim and long speaker. As a result, it is possible to provide the speaker which has a long structure but is unlikely to cause breakeup resonance, and is thereby capable of having smooth frequency characteristics to offer good sound quality.

Furthermore, the magnetic circuit may be an internal magnet type magnetic circuit, the magnetic circuit including: a yoke having a concave at center of the yoke; a magnet disposed on a bottom of the concave of the yoke; a plate in a cuboidal shape, the plate disposed in the concave of the yoke and fixed on a top surface of the magnet; a through hole penetrating the plate, the magnet, and the yoke at center of the plate, the magnet, and the yoke; a magnetic gap internal space surrounded by (a) inside walls of the at least one voice coil bobbin and (b) an outer periphery surface of the plate; and a magnetic fluid that is liquid having property of being adsorbed by magnetic force, the magnetic fluid filling the magnetic gap internal space, wherein the magnetic fluid blocks transmission of sound in a space except the through hole, the sound being generated by the diaphragm, and the space being surrounded by the diaphragm and the at least one voice coil bobbin.

With the structure, when the speaker reproduces sound, the voice coil bobbin does not move beyond the magnetic gap internal space. Thereby, air can be blocked. In addition, it is possible to prevent the magnetic fluid from dispersing due to penetration resulting from separation. In other words, in the speaker, regardless of vibration of the diaphragm, the magnetic fluid is not dispersed and can be kept stable.

Still further, the yoke may have a cross-sectional surface in a shape of a concave viewed in a shorter-side direction of the speaker, the yoke has sides each in a shape of a substantially arch facing a corresponding one of longer sides of the plate viewed in a rear-side direction of the speaker, and the yoke has a width along the shorter-side direction at center of the yoke viewed in the longer-side direction is greater than a width along the shorter-side direction at an end of the yoke viewed in the longer-side direction, and the yoke may include a magnetic gap including the magnetic gap internal space, the magnetic gap being surrounded by (a) the longer sides of the plate and (b) the sides of the yoke each facing the corresponding one of the longer sides of the plate.

With the above structure, the magnetic circuit can cope with change of a shape of the voice coil bobbin which is caused by pressure of the magnetic fluid. As a result, reduction of the efficiency can be prevented.

Still further, the magnetic circuit may be an external magnet type magnetic circuit, the magnetic circuit including: a yoke in an inverted T shape, the yoke having a center pole; a magnet disposed outside the center pole; a plate disposed outside the center pole and fixed on a top surface of the magnet; a though hole penetrating the center pole at center; a magnetic gap internal space that is a gap between (a) inside walls of the at least one voice coil bobbin and (b) an outer periphery surface of the center pole; and a magnetic fluid that is liquid having property of being adsorbed by magnetic force, the magnetic fluid filling the magnetic gap internal space, wherein the magnetic fluid blocks transmission of sound in a space except the through hole, the sound being generated by the diaphragm, and the space being surrounded by the diaphragm and the at least one voice coil bobbin.

With the above structure, when the speaker reproduces sound, the voice coil bobbin does not move beyond the magnetic gap internal space. Thereby, air can be blocked. In addition, it is possible to prevent the magnetic fluid from dispersing due to penetration resulting from separation. In other words, in the speaker, regardless of vibration of the diaphragm, the magnetic fluid is not dispersed and can be kept stable.

Still further, being viewed from a rear-side direction of the speaker, the plate may have a longer side facing the center pole, the longer side being in a shape of a substantial arch, and a width along a shorter-side direction of the speaker at center of the plate viewed in the longer-side direction is greater than a width along the shorter-side direction at an end of the plate viewed in the longer-side direction.

With the above structure, the magnetic circuit can cope with change of a shape of the voice coil bobbin which is caused by pressure of the magnetic fluid. As a result, reduction of the efficiency can be prevented.

Still further, the diaphragm may be substantially plane in a shape having a surface with a plurality of reinforcement ribs, the reinforcement ribs being a series of convexes and concaves arranged in the longer-side direction.

With the above structure, it is possible to increase a stiffness of the diaphragm in the shorter-side direction, and thereby to prevent resonance.

Still further, the edge may be in a shape of a roll having a top and a base, the top being thinner than the base, and the roll having a thickness getting thicker from the top to the base.

Still further, the diaphragm may have a longer side and a shorter side, wherein a length of the shorter side is 0.5 or less assuming that a length of the longer side is 1.

Still further, the speaker may further include a joint having one end perpendicularly connected to the diaphragm; and a damper having (a) one end connected to an other end of the joint, and (b) an other end connected to a frame of the speaker, wherein the voice coil is supported by the frame using the joint and the damper via the diaphragm.

With the above structure, the speaker has a stable support body using the dampers and the edges. As a result, it is possible to prevent rolling phenomena of the diaphragm with a large amplitude.

Still further, inside the through hole, the joint may joint the diaphragm and the one end.

In accordance with a second aspect of the present invention, there is provided an electronic device including the above-described speaker.

The present invention can provide a speaker which has a long structure but is unlikely to cause breakeup resonance, and is thereby capable of having smooth frequency characteristics to offer good sound quality. The present invention can also provide an electronic device including the speaker.

FURTHER INFORMATION ABOUT TECHNICAL BACKGROUND TO THIS APPLICATION

The disclosure of Japanese Patent Application No. 2010-068890 filed on Mar. 24, 2010 including specification, drawings and claims is incorporated herein by reference in its entirety.

BRIEF DESCRIPTION OF THE DRAWINGS

These and other objects, advantages and features of the present invention will become apparent from the following description thereof taken in conjunction with the accompanying drawings that illustrate specific embodiments of the present invention. In the Drawings.

DESCRIPTION OF THE PREFERRED EMBODIMENT(S)

First Embodiment

Figure 1:
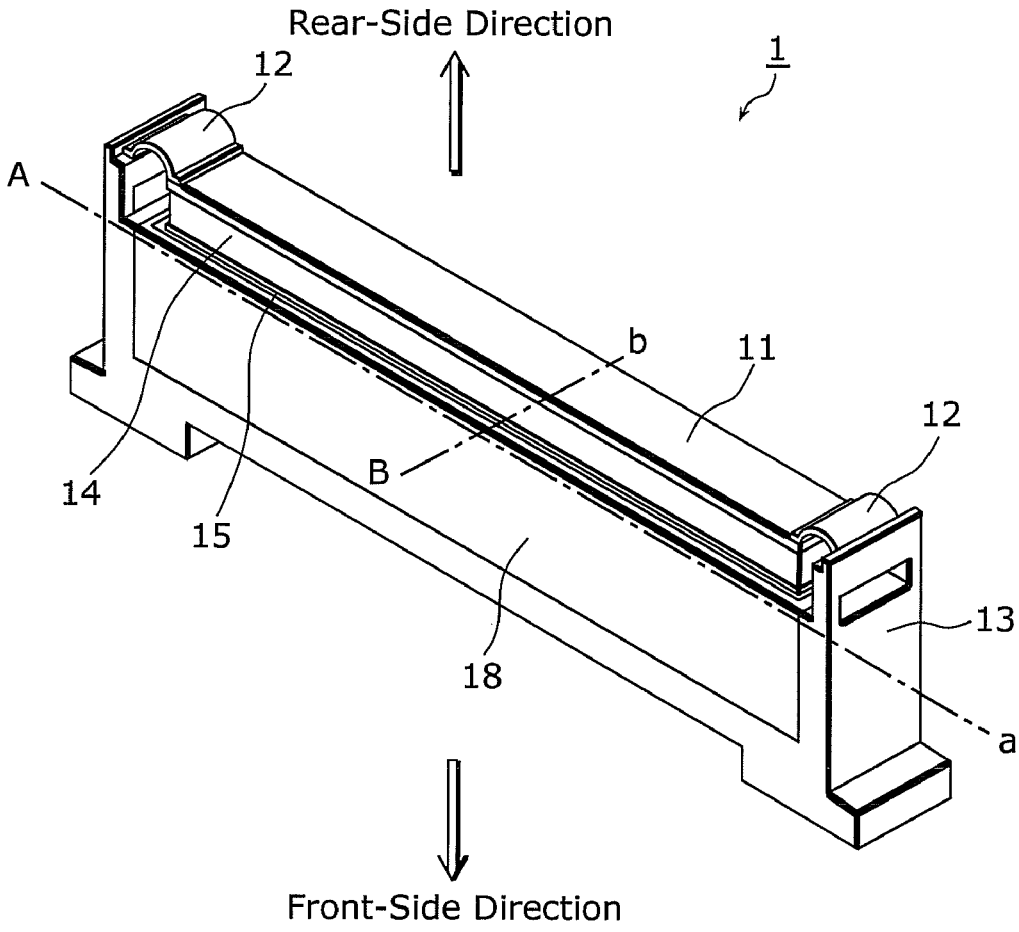
FIG. 1 is a view of a speaker according to a first embodiment of the present invention.

The following describes a speaker according to the first embodiment of the present invention. Same reference numerals are assigned to the identical parts of FIGS. 1 to 22, so that explanation of the identical parts will be given once and will not be repeated.

Figure 2:
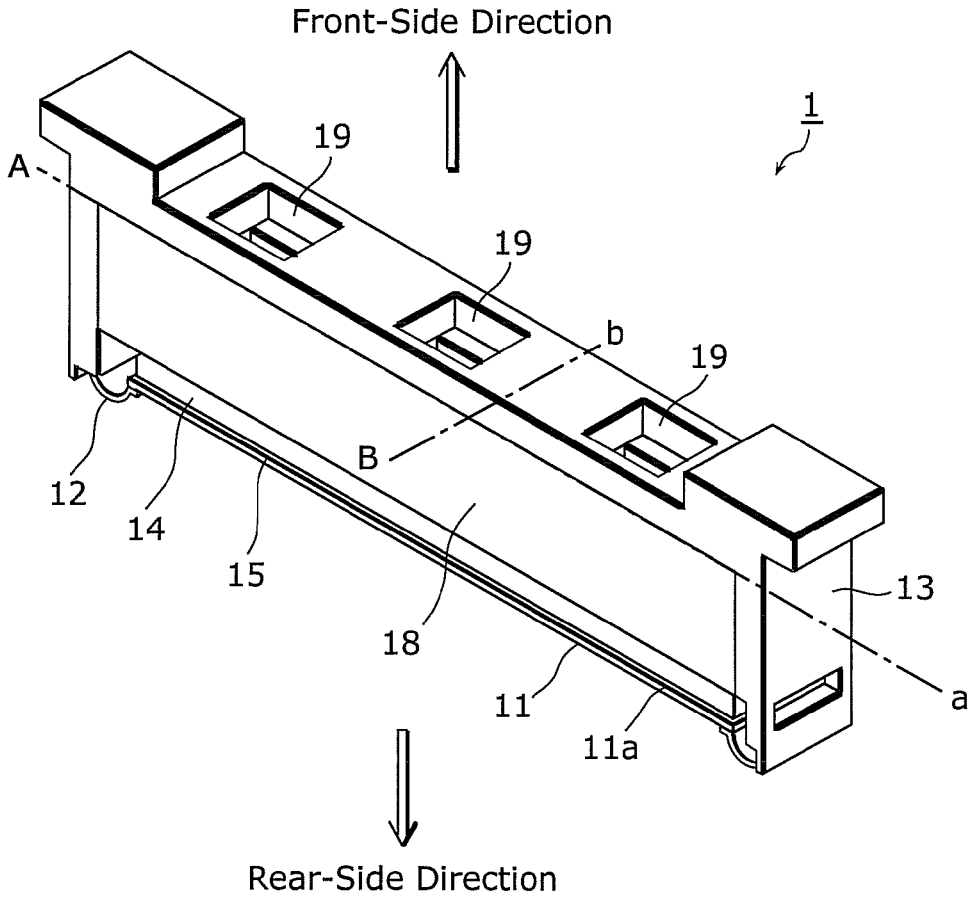
FIG. 2 is another view of the speaker according to the first embodiment of the present invention.
Figure 3:
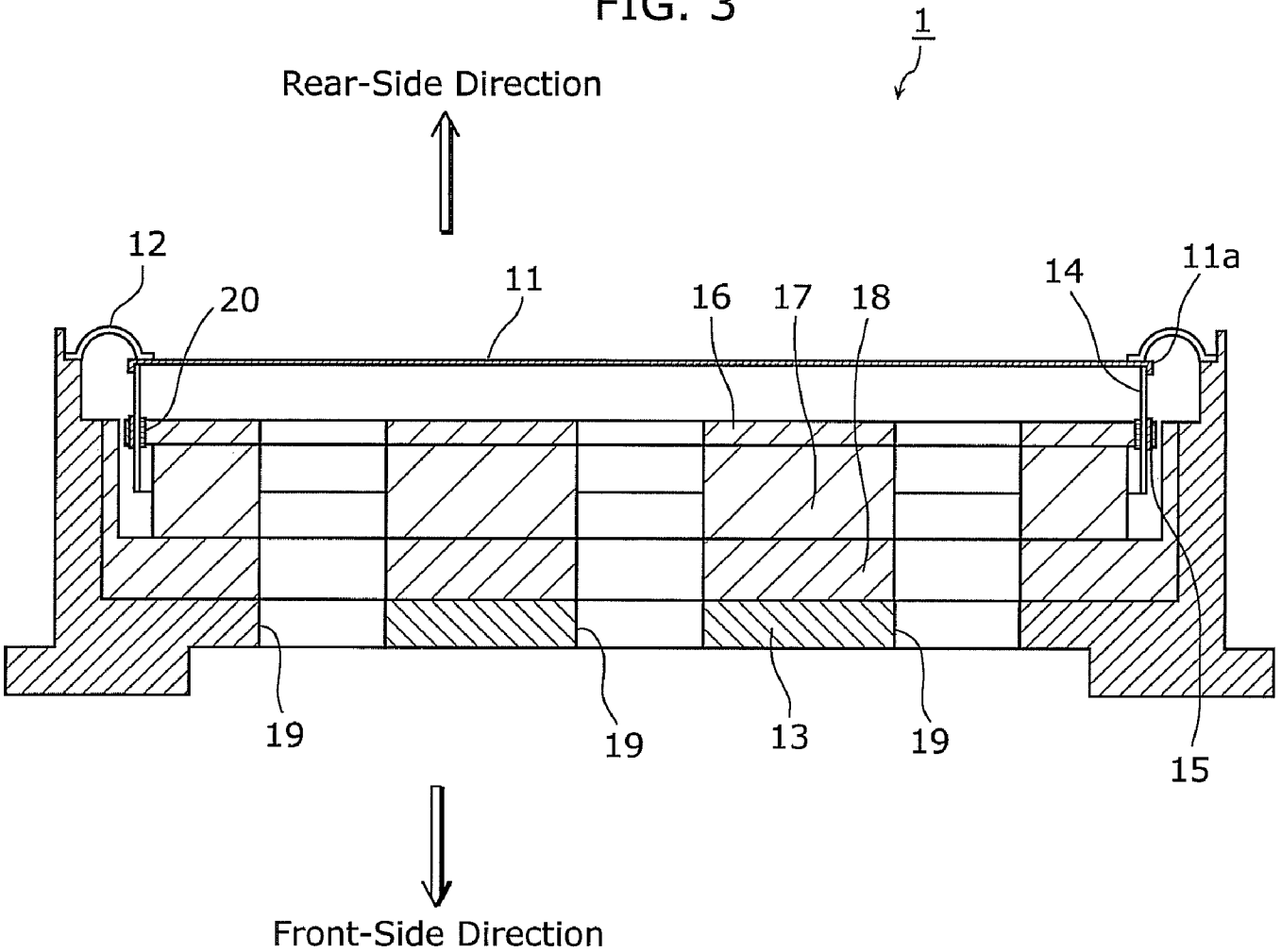
FIG. 3 is still another view of the speaker according to the first embodiment of the present invention.
Figure 4:
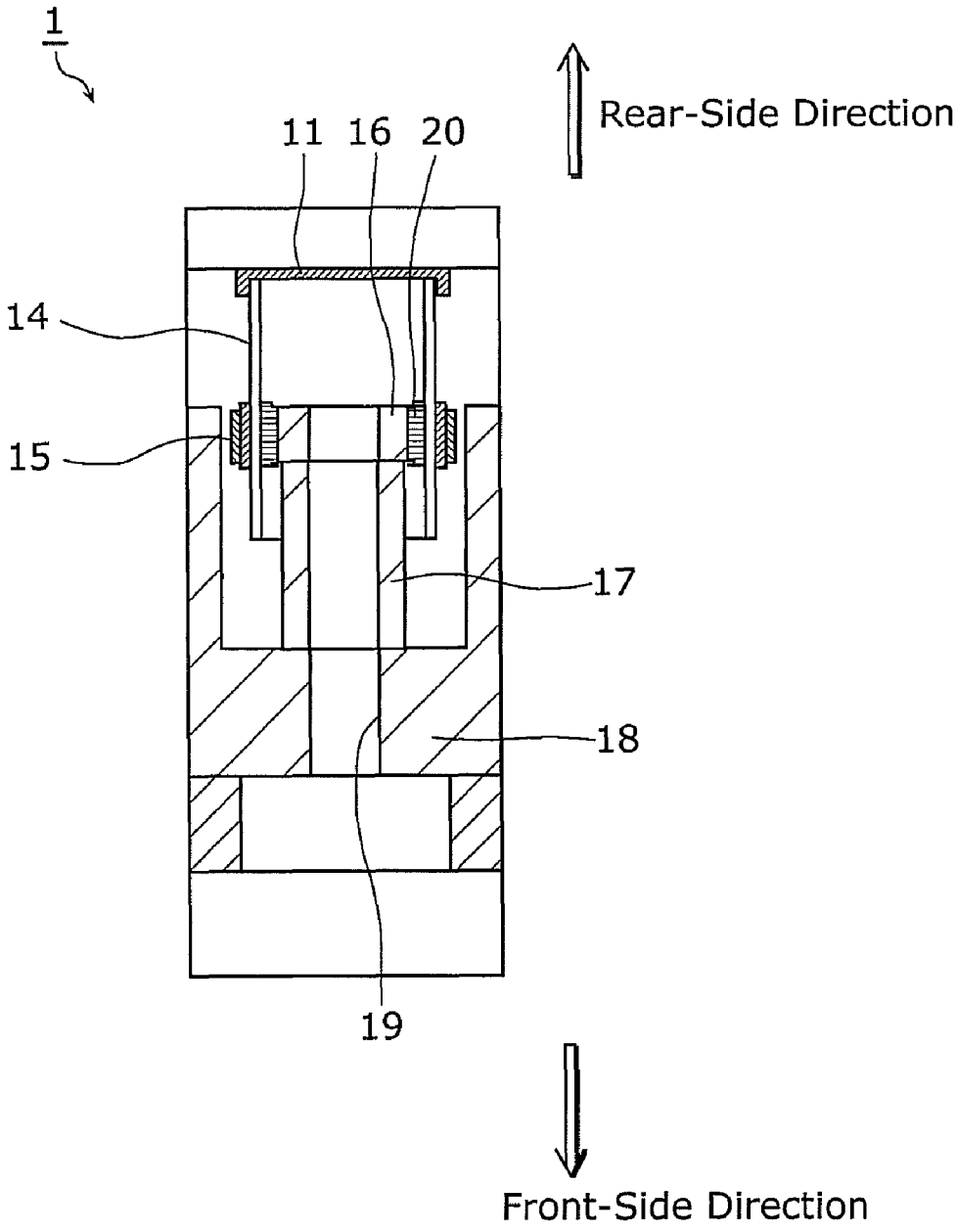
FIG. 4 is still another view of the speaker according to the first embodiment of the present invention.
Figure 5:
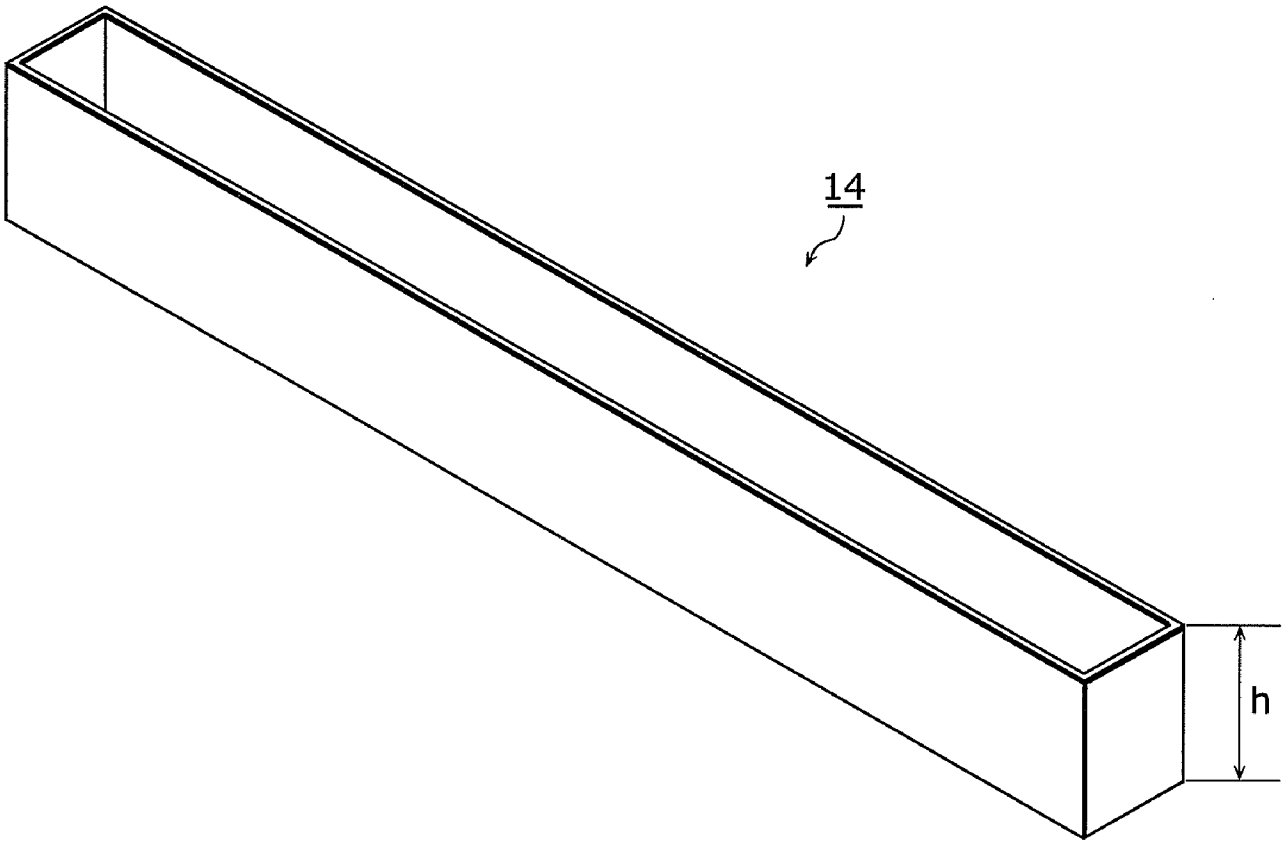
FIG. 5 is a view of a voice coil bobbin included in the speaker according to the first embodiment of the present invention.
Figure 6:
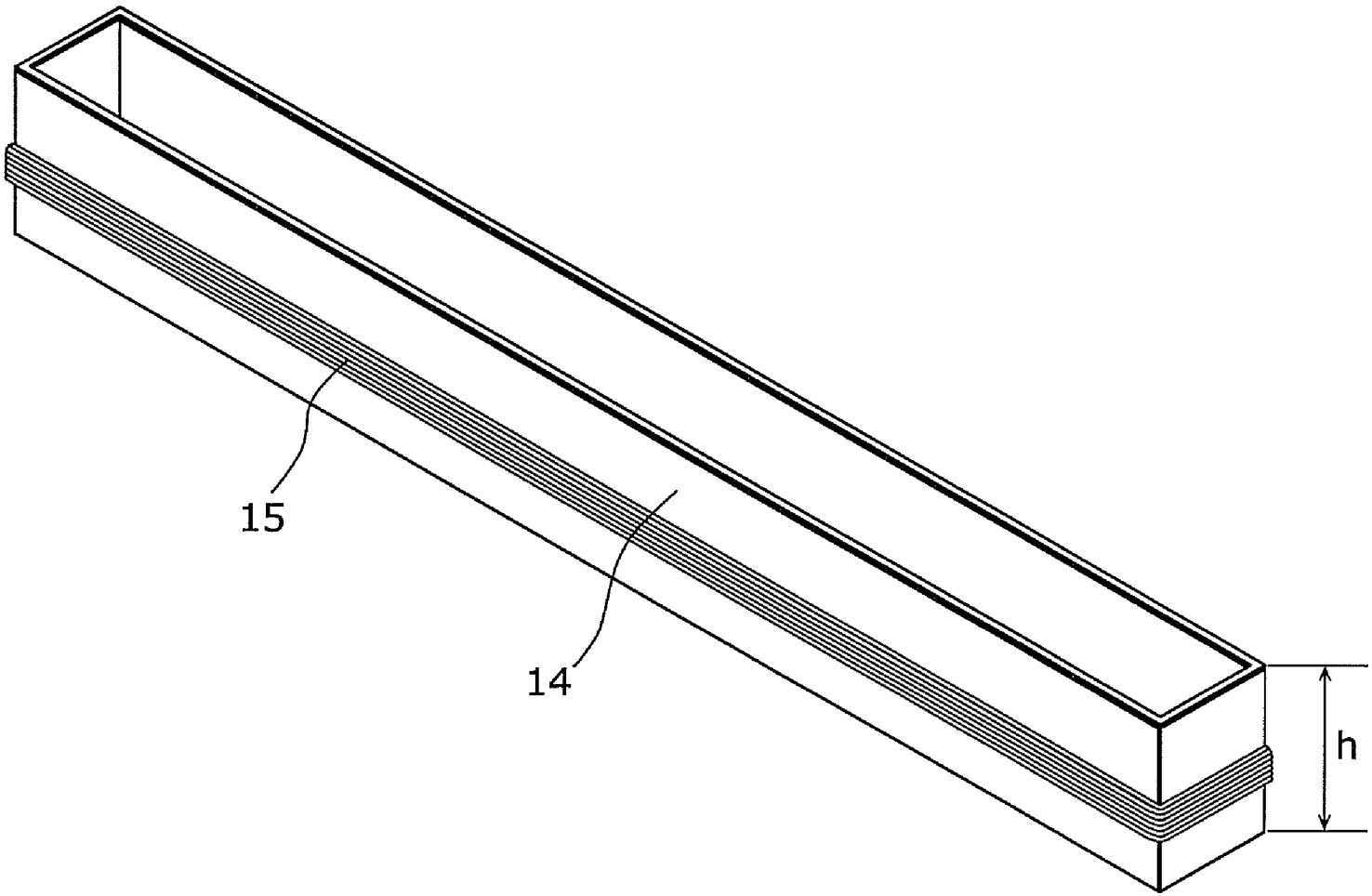
FIG. 6 is a view of a voice coil included in the speaker according to the first embodiment of the present invention.
Figure 7:
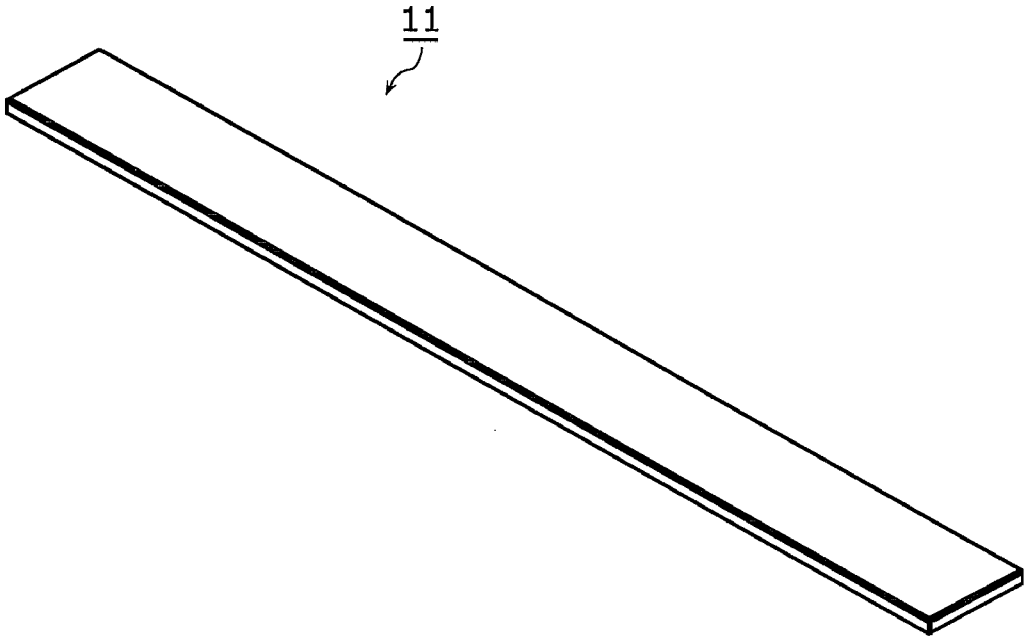
FIG. 7 is a view of a speaker diaphragm included in the speaker according to the first embodiment of the present invention.
Figure 8:
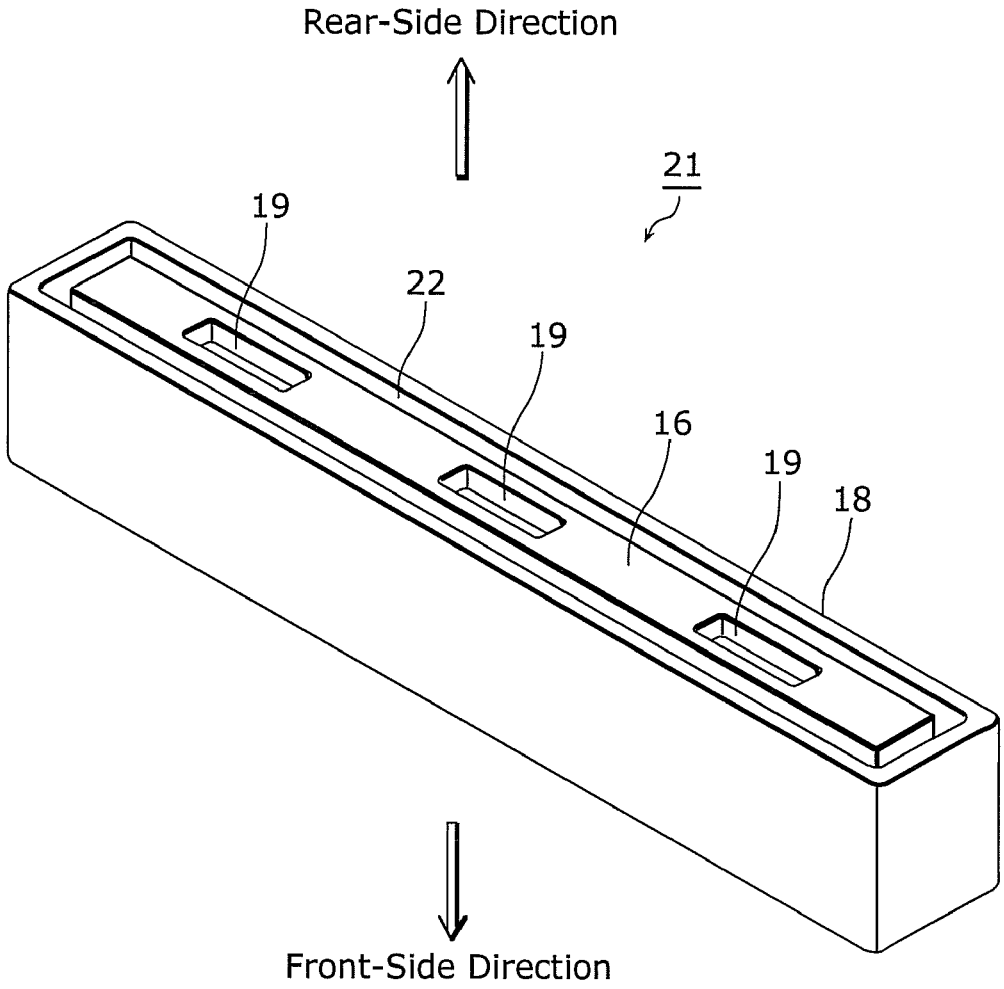
FIG. 8 is a view of a magnetic circuit included in the speaker according to the first embodiment of the present invention.

FIGS. 1 to 4 are view of the speaker according to the first embodiment of the present invention. FIG. 1 is a perspective view of the speaker according to the first embodiment, placing a rear side of the speaker up (in other words, viewed from a rear-side direction). FIG. 2 is a perspective view of the speaker according to the first embodiment, placing a front side of the speaker up (in other words, viewed from a front-side direction). FIG. 3 is a cross-sectional view of the speaker taken along line A-a of FIG. 1. FIG. 4 is a cross-sectional view of the speaker taken along line B-b of FIG. 1. FIGS. 5 to 8 are views of various parts included in the speaker shown in FIG. 1. FIG. 5 shows a voice coil bobbin. FIG. 6 shows a voice coil. FIG. 7 shows a diaphragm. FIG. 8 shows a magnetic circuit.

The speaker 1 shown in FIGS. 1 to 4 includes a diaphragm 11, roll edges 12, a frame 13, a voice coil bobbin 14, a voice coil 15, and a magnetic circuit 21. The magnetic circuit 21 includes a plate 16, a magnet 17, and a yoke 18. The speaker 1 is a long structure in which a length in a vertical direction (in other words, along a longer-side direction of the speaker) is different from a length in a horizontal direction (in other words, along a shorter-side direction of the speaker). For example, the speaker 1 has a long and slim structure where a length in a vertical direction (along the longer-side direction) that is equal to or more than twice than a length in a horizontal direction (along the shorter-side direction). The speaker 1 emits sound in the front-side direction shown in FIGS. 1 to 4.

The following describes the entire structure of the speaker 1 with reference to FIGS. 1 to 8.

The diaphragm 11 is a plane diaphragm that is a long flat plate. The diaphragm 11 is made of a sheet material such as paper, aluminium, or polyimide. For example, the diaphragm 11 is slim and long in shape, where a length in a vertical direction (along the longer-side direction) is different from a length in a horizontal direction (along the shorter-side direction). A ratio of the length in the vertical direction (along the longer-side direction) to the length in the horizontal direction (along the shorter-side direction) is 2:1 or more. Moreover, the roll edges 12 are fixed to both ends of the diaphragm 11 viewed in the longer-side direction. On the other hand, the roll edges 12 and the like are not fixed to other ends of the diaphragm 11 viewed in the shorter-side direction. With the above structure, the diaphragm 11 is supported by the roll edges 12 to allow the diaphragm to vibrate. Since the roll edges 12 are not provided to the ends viewed in the shorter-side direction, the roll width of the roll edges 12 is not necessary. In other words, since there is no roll edge 12 at the ends in the shorter-side direction, the width along the shorter-side direction of the speaker 1 can be decreased by the widths of the roll edges 12. Furthermore, the voice coil bobbin 14 is fixed to entire outer periphery 11*a* of the front surface (viewed from the front-side direction) of the diaphragm 11. With the structure, driving force is applied to the diaphragm 11 in the longer-side direction. As shown in FIG. 3, it is preferable that the outer periphery 11*a* of the diaphragm 11 has an L shape. The L shape of the outer periphery 11*a* allows the diaphragm 11 to be more firmly fixed to the voice coil bobbin 14.

The voice coil bobbin 14 is in a shape of a substantially square pillar, having a height that is equal to or more than twice as a vibrational amplitude of the diaphragm 11. A periphery of an opening of the voice coil bobbin 14 is directly connected to the diaphragm 11. The voice coil bobbin 14 supports the diaphragm 11 and also transmits vibration to the diaphragm 11.

More specifically, as shown in FIG. 5, the voice coil bobbin 14 has a height h that is equal to or more than twice as a maximum amplitude of the diaphragm 11. Therefore, the shape of the voice coil bobbin 14 is long and a substantially square pillar, having an opening at a surface in the longer-side direction. The voice coil bobbin 14 is made of a high-polymer film such as polyimide or a thin sheet material such as aluminium. Moreover, the voice coil bobbin 14 is wound by the voice coil 15 at a center position (close to h/2) in a height direction. As shown in FIGS. 3 and 4, the diaphragm 11 is fixed to one edge (the periphery of the opening) of the voice coil bobbin 14. Thereby, the voice coil bobbin 14 supports the diaphragm 11 and transmits vibration to the diaphragm 11.

The voice coil 15 is wound around the outer periphery of the voice coil bobbin 14, at the substantial center of the voice coil bobbin 14 in a height direction. More specifically, the voice coil 15 converts voice current into vibration. As shown in FIG. 6, the voice coil 15 is wound around the voice coil bobbin 14 at the center in a height direction of the voice coil bobbin 14. The voice coil 15 is, for example, a wire material made of copper, aluminium, or the like.

The roll edges 12 are provided to ends of the diaphragm 11 viewed in the longer-side direction. The roll edges 12 support the diaphragm 11 to allow the diaphragm 11 to vibrate. More specifically, as shown in FIGS. 1 and 3, each of the roll edges 12 is in a shape of a roll having a semicircular cross-sectional surface. Each of the roll edges 12 has one edge fixed to the end of the diaphragm 11 viewed in the longer-side direction, and the other edge fixed to the frame 13. With the structure, the roll edges 12 support the diaphragm 11 so that the voice coil 15 can vibrate (the diaphragm 11 can vibrate).

The following explains a material and a shape of a cross-sectional thickness of the roll edges 12. The roll edges 12 are preferably formed by mold injection using foamed rubber material, solid rubber, or high-polymer material. If the roll edges 12 are made of the above-described material, the thickness of the roll edges 12 can be freely designed. Therefore, it is desirable that a roll of each of the roll edges 12 has a top thinner than a base. In other words, it is preferable that each of the roll edges 12 is in a shape of a roll having a top and a base, that the top is thinner than the base, and that the thickness is getting thicker from the top to the base. With the above structure of the roll edges 12, when the diaphragm 11 has a small amplitude, the top is deformed and thereby moved softly. On the other hand, when the diaphragm 11 has a large amplitude, the base is deformed and thereby gradually hardened. As a result, a soft-clip support system can be offered. In other words, it is possible to offer a good support system that can provide desired movement (maximum amplitude movement) to the diaphragm 11, preventing that the roll edges 12 suddenly pull the diaphragm 11 when the diaphragm 11 has a maximum amplitude.

The magnetic circuit 21 is a circuit for driving the voice coil 15. In other words, the magnetic circuit 21 generates driving force for driving the voice coil 15. The magnetic circuit 21 has a long shape similar to the shape of the voice coil 15 (in this example, a slim and long shape). As shown in FIGS. 4 and 8, the magnetic circuit 21 includes the plate 16, the magnet 17, the yoke 18, through holes 19, and a magnetic gap 22. As shown in FIGS. 4 and 8, the magnetic circuit 21 is an internal magnet type magnetic circuit in which the magnet 17 is provided inside the yoke 18.

The yoke 18 is a part to which the magnet 17 is adhered (fixed). A cross-sectional surface of the yoke 18 along the shorter-side direction has a substantially U shape. In other words, the yoke 18 has a concave at its center. The magnet 17 is fixed (provided) on the bottom of the concave of the yoke 18. The plate 16 is in a cuboidal shape. The plate 16 is provided in the concave of the yoke 18 and fixed (provided) on the top surface of the magnet 17.

Each of the through holes 19 is formed to penetrate the plate 16, the magnet 17, and the yoke 18 at the center. The through holes 19 transmit sound generated by the diaphragm 11 towards the front surface of the speaker 1 (viewed from the front-side direction).

The magnetic gap 22 is a gap between the plate 16 and the yoke 18. The magnetic gap 22 includes an internal part of the magnetic gap (hereinafter, referred to as a "magnetic gap internal space") that is provided in a gap between the plate 16 and inside walls of the concave of the yoke 18. In the magnetic gap 22, magnetic flux is concentrated to occur. Since the magnetic gap 22 has a shape similar to the shape of the voice coil 15, the magnetic gap 22 looks like two long lines along the longer-side direction, being viewed from the rear-side direction as shown in FIG. 8.

The magnetic gap internal space is a gap between inside walls of the voice coil bobbin 14 and an external side of the plate 16. Filling of magnetic fluid 20, which has property of being adsorbed by magnetic force, in the magnetic gap internal space blocks transmission of the sound generated by the diaphragm 11, between the inside and the outside of the energetic gap 22.

The magnetic fluid 20 is fluid having magnetic adsorptive property that is property of being adsorbed by magnetic force. The magnetic fluid 20 is filled (located) to occupy the magnetic gap internal space. Thereby, the magnetic fluid 20 blocks transmission of sound, which is generated by the diaphragm 11, in the space that is surrounded by the diaphragm 11 and the inside walls of the voice coil bobbin 14, except the through holes 19. In other words, the magnetic fluid 20 blocks transmission of the sound generated by the diaphragm 11, between the inside and the outside of the space.

Thus, the speaker 1 has the above-described structure.

Next, the effects of the speaker 1 having the above-described structure are described.

Here, the vibration system of the speaker 1 is described. First, current is applied to the voice coil 15. Thereby, driving force occurs in the voice coil 15 by the applied current and a magnetic field caused by the magnetic circuit 21. The driving force allows the diaphragm 11 to vibrate via the voice coil bobbin 14. More specifically, the voice coil 15 causes the diaphragm 11 to vibrate by the generated driving force. Sound occurs by the vibration of the diaphragm 11, and is emitted to the open space.

Here, in general, if a single plane diaphragm made of a thin sheet is driven at its center, various resonances are induced. Thereby, the sound pressure-frequency characteristics have many peaks and dips. Especially, if a plate diaphragm is slim and long in shape and is made of a thin film material, various resonances occur in low frequency along the longer-side direction.

On the other hand, according to the first embodiment of the present invention, the voice coil bobbin 14 is fixed to the entire outer periphery of the diaphragm 11. As a result, driving force is applied to the entire diaphragm 11 along the longer-side direction. This offers advantages of controlling all resonance modes in the longer-side direction.

A length of the diaphragm 11 in the shorter-side direction is equal to or shorter than a half of a length of the diaphragm 11 in the longer-side direction. Therefore, the resonance frequency in the shorter-side direction is higher than frequency in the longer-side direction. Such a quite slim and long diaphragm 11 can offer advantages of enlarging its used band to high frequency, by driving the entire surface of the diaphragm 11 in the longer-side direction.

The following describes the support system of the speaker 1.

First, the description is given for the advantages of the provision of the roll edges 12 in the speaker 1.

In general, edges serve to support a diaphragm to allow the diaphragm to execute pistonic vibration, and also to block air between front and rear of the diaphragm.

As described above, the roll edges 12 in the speaker 1 are fixed only to the ends of the diaphragm 11 viewed in the longer-side direction. In other words, the roll edges 12 are provided (fixed) to both ends of the diaphragm 11 viewed in the longer-side direction to support the diaphragm 11 to allow the diaphragm to vibrate.

With the above structure, the speaker 1 can reduce a stiffness more than general speakers having edges connected to an entire periphery of a diaphragm to support the diaphragm. The following explains why the structure having edges supporting an entire periphery of a diaphragm has a high stiffness. This is because a stiffness is proportional to a periphery length of an edge, and because an inner periphery length of the edge is different from an outer periphery length of the edge at a corner of a diaphragm. More specifically, if the inner periphery length and the outer periphery length of the same edge are different, a diaphragm executing pistonic vibration needs motion with material shrinkage. The shrinkage motion requires a huge power. As a result, a stiffness is increased.

As described above, in the speaker 1 according to the first embodiment of the present invention, a periphery length of each of the edges is short. In addition, the edges, which are not provided to the entire periphery of the diaphragm, are not connected to each other. Thereby, an inner periphery length of each edge is equal to an outer periphery length of the edge. As a result, a stiffness can be reduced. In other words, the provision of the roll edges 12 in the speaker 1 can reduce a fundamental resonance frequency of the speaker 1.

The following explains why the roll edges 12 provided in the speaker 1 can also block air between front and rear of the diaphragm 11.

As described above, in the speaker 1, the magnetic fluid 20 is filled in the gap (the magnetic gap internal space) between the internal sides (inside walls) of the voice coil bobbin 14 and the outer periphery surfaces of the plate 16. Thereby, the magnetic fluid 20 serves to prevent the voice coil 15 from being in contact with the magnetic circuit 21. In addition, the magnetic fluid 20 blocks transmission of sound generated by the diaphragm 11, between the inside and the outside of the energetic gap 22.

More specifically, in the speaker 1 having the above structure, it is not necessary to provide the roll edges 12 to the entire periphery of the diaphragm 11 in order to block air between front and rear of the diaphragm 11.

Therefore, as described above, in the speaker 1 according to the first embodiment of the present invention, the provision of the magnetic fluid 20 can block air between front and rear of the diaphragm 11, and the provision of the roll edges 12 can reduce a stiffness. As a result, the speaker 1 can have good low-sound reproduction characteristics.

The following describes a relationship between a height of the voice coil bobbin 14 and a vibrational amplitude.

In the speaker 1, the height h of the voice coil bobbin 14 is assumed to be equal to or more than twice of a maximum variation amplitude (maximum amplitude). The vibrational amplitude varies according to frequency of reproduced sound.

For example, assuming that the speaker 1 has a diameter of approximately 8 cm for up to low-frequency range of 100 HZ and a maximum sound pressure level of 87 dB/m, the diaphragm 11 has a maximum amplitude of 4 mm. In the above case, the voice coil bobbin 14 has a height h of 8 mm or more. Desirably, the voice coil bobbin 14 has a height h of 10 mm in consideration of a common amplitude allowance for the diaphragm 11.

In practice, a maximum amplitude of the diaphragm 11 is determined depending on parts (the roll edges 12) included in the speaker 1. Therefore, a maximum amplitude of the diaphragm 11 is set based on physical limit values of the parts included in the speaker 1.

More specifically, a maximum amplitude of the diaphragm 11 may be determined based on the state where the roll edges 12 are extended. In other words, in the speaker 1, a maximum amplitude of the diaphragm 11 corresponds to situation where the roll edges 12 are liner in shape, without considering elasticity of its material.

Each of the roll edges 12 is in a shape of a roll. The roll has a semicircular cross-sectional surface bridging from the frame 13 to the diaphragm 11. Each of the roll edges 12 are changing its shape depending on the vibrational amplitude, thereby supporting the diaphragm 11 to allow the diaphragm 11 to execute stable pistonic vibration. Then, when the rolls of the roll edges 12 are fully extended in line shape, the vibrational amplitude of the diaphragm 11 reaches a maximum value.

For example, it is assumed that the shape of the roll of the roll edge 12 is a semicircle. Under the assumption, when the roll shape is extended in line shape, it is considered to be seen a right triangle having (a) a hypotenuse that is the length of the roll edge 12 bridging from the frame 13 to the diaphragm 11, (b) a base that is a gap between the frame 13 and the diaphragm 11, and (c) a height that is a maximum amplitude distance of the diaphragm 11. From the above, it is learned that the maximum amplitude distance of the diaphragm 11 is 2.4 times greater than the radius of the roll. Therefore, based on the above calculation, the height h of the voice coil bobbin 14 is preferably equal to or more than 4.8 times greater than the radius of the roll of the roll edges 12.

On the other hand, for design values, a maximum amplitude of the diaphragm 11 may be set to 4 mm. In the above case, based on the above calculation method, the radius of the roll of the roll edges 12 is 1.7 mm, the gap between the frame 13 and the diaphragm 11 is 3.4 mm.

As described above, the speaker 1 according to the first embodiment of the present invention, the roll edges 12 are provided only to both ends of the diaphragm 11 viewed in the longer-side direction, and not provided to ends of the diaphragm 11 viewed in the shorter-side direction. With the above structure, it is possible to decrease the width of the speaker 1 by the width of the roll edges 12 which are not provided to the ends in the shorter-side direction. As a result, the speaker 1 is manufactured to be slim. More specifically, if the speaker has a diameter of approximately 8 cm and each of the edges has a width of 3.4 mm, a width of the speaker along the shorter-side direction can be decreased by total 10.8 mm (edge widths 3.4 mm×2+edge overlap margins (2 mm×2)). As a result, the speaker is manufactured to be slim.

Next, the advantages of the structure of the magnetic fluid 20 and the voice coil bobbin 14 are described.

As described above, the voice coil bobbin 14 has a height equal to or more than twice than a maximum amplitude of the diaphragm 11. The voice coil 15 generating driving force is wound around the center in the height direction of the voice coil bobbin 14. In addition, in the magnetic gap internal space that is a gap between the internal sides (inside walls) of the voice coil bobbin 14 and the external side of the plate 16, the magnetic fluid 20 adsorbed by magnetic force is filled.

With the above structure, when the speaker 1 reproduces sound, the voice coil bobbin 14 does not move beyond the magnetic gap internal space of the magnetic circuit 21. In other words, the voice coil bobbin 14 does not move beyond a space between the outer periphery surfaces of the plate 16 and the internal side surfaces of the concave of the yoke 18. Therefore, the magnetic fluid 20 is not separated from the voice coil bobbin 14. As a result, keeping moist, the voice coil bobbin 14 vibrates by surface tension with the magnetic fluid 20. Here, if the magnetic fluid 20 loses contact from (is separated from) the voice coil bobbin 14, there is a risk that the voice coil bobbin 14 would re-penetrate the magnetic fluid 20 to split the magnetic fluid 20, and the magnetic fluid 20 would be dispersed. However, the structure described in the embodiment, the re-penetration resulting from separation does not occur.

Therefore, the magnetic fluid 20 remains inside the voice coil bobbin 14, not separated from the plate 16. As a result, it is possible to keep effects of blocking air between front and rear of the diaphragm 11.

Moreover, the speaker 1 includes roll edges 12 which are provided (fixed) to both ends of the diaphragm 11 viewed in the longer-side direction to support the diaphragm 11 to allow the diaphragm 11 to vibrate. This structure can also prevent the voice coil bobbin 14 from being in contact with the plate 16.

Furthermore, as described above, the voice coil 15 is wound around the external sides of the voice coil bobbin 14. Therefore, dimensions of the inside of the voice coil bobbin 14 can be kept almost uniformly. The above structure makes it possible to keep stabilizing the contact between the inside of the voice coil bobbin 14 and the magnetic fluid 20, even if the diaphragm 11 vibrates.

As described above, according to the first embodiment, it is possible to provide the speaker 1 which has a long structure but is unlikely to cause breakeup resonance, and is thereby capable of having smooth frequency characteristics to offer good sound quality.

More specifically, edges are not provided to the ends of the diaphragm 11 in the shorter-side direction. Thereby, the speaker 1 is quite slim and long in shape. Furthermore, the voice coil bobbin 14 has a height equal to or more than twice of a vibrational amplitude of the diaphragm 11. The voice coil 15 is provided at the center in the height direction of the voice coil bobbin 14. The diaphragm 11 is provided to an end of the voice coil bobbin 14 in the height direction. With the above structure, it is possible to provide the speaker 1 which has a long structure but is unlikely to cause breakeup resonance, and is thereby capable of having smooth frequency characteristics to offer good sound quality.

In addition, the speaker 1 according to the first embodiment of the present invention includes the magnetic fluid 20 in the magnetic gap internal space between the voice coil bobbin 14 and the plate 16. With the above structure, when the speaker 1 reproduces sound, the voice coil bobbin does not move beyond the magnetic gap internal space. Thereby, air can be blocked. In addition, it is possible to prevent the magnetic fluid 20 from dispersing due to penetration resulting from separation. In other words, in the speaker 1, regardless of vibration of the diaphragm 11, the magnetic fluid 20 is not dispersed and can be kept stable.

Thereby, it is possible to have a stable support structure and to block air between front and rear of the diaphragm 11, without providing the roll edges 12 to the entire periphery of the diaphragm 11. Then, regarding the shape of the speaker 1, the width of the speaker 1 can be decreased by the widths of the roll edges 12 which are not provided to the ends of the speaker 1 in the shorter-side direction. As a result, it is possible to manufacture the speaker 1 to be slim.

Figure 9:
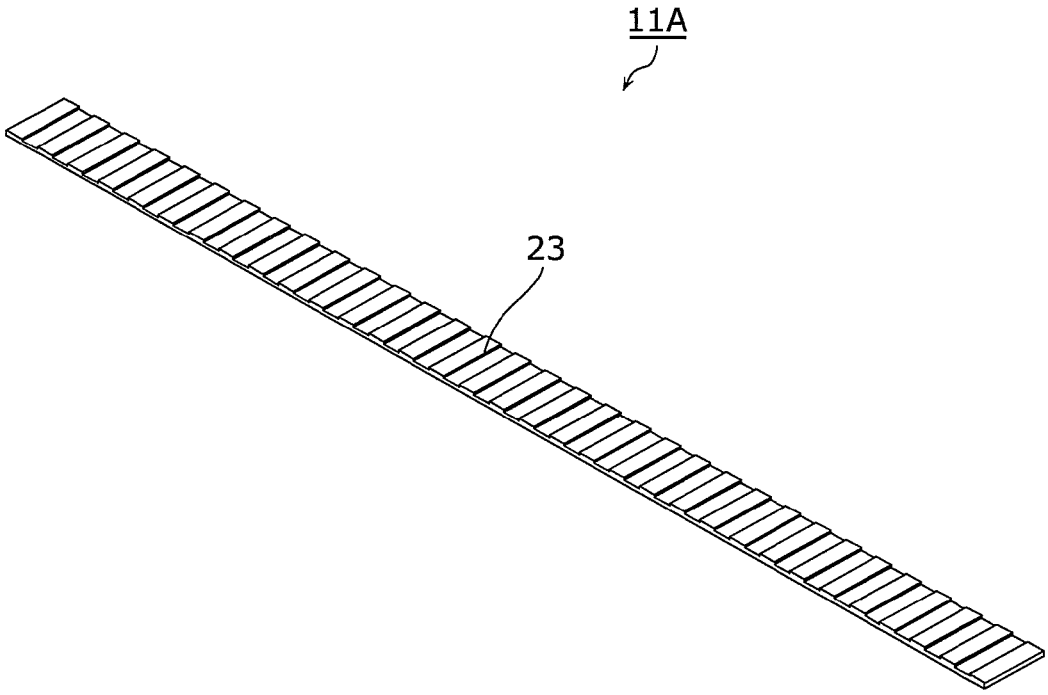
FIG. 9 is a view of an example of a diaphragm included in the speaker according to the first embodiment of the present invention.

It should be noted that it has been described in the first embodiment that the diaphragm 11 is a plane diaphragm made of a long flat plate, but the diaphragm 11 is not limited to the above. For example, a diaphragm 11A shown in FIG. 9 may be used. The diaphragm 11A has reinforcement ribs 23 to have an uneven surface. In other words, the diaphragm 11A may be substantially plane in a shape having a surface with a plurality of reinforcement ribs that are a series of convexes and concaves arranged in the longer-side direction. FIG. 9 is a view of an example of the diaphragm included in the speaker 1 according to the first embodiment of the present invention. As described above, if the diaphragm 11A has the reinforcement ribs 23, resonance frequency is increased in the shorter-side direction. As a result, it is possible to reproduce sound up to higher frequency without distortion.

It should also be noted that it has been described in the first embodiment that the magnetic circuit 21 is an internal magnet type magnetic circuit in which the magnet 17 is provided inside the yoke 18. However, the magnetic circuit 21 is not limited to the above. Of course, an external magnet type magnetic circuit may be also used. The following describes a variation of the first embodiment with reference to FIGS. 10 to 13.

Figure 10:
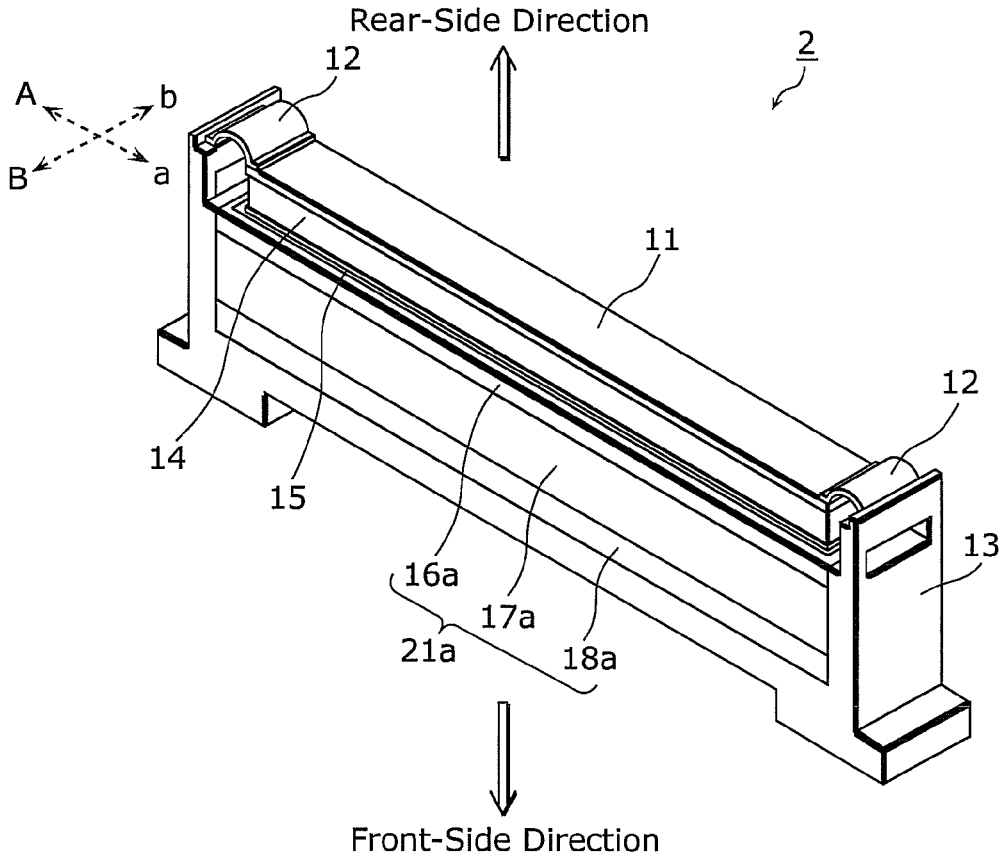
FIG. 10 is a view of a speaker according to a variation of the first embodiment of the present invention.
Figure 11:
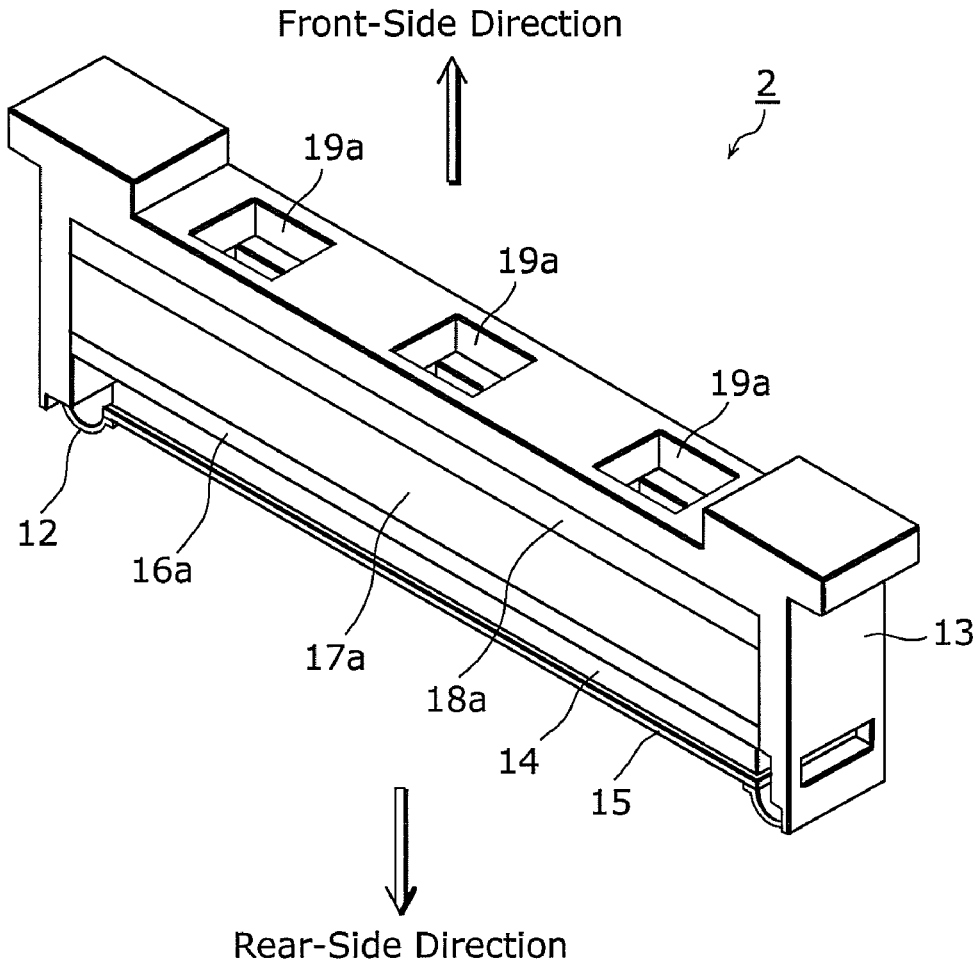
FIG. 11 is another view of the speaker according to the variation of the first embodiment of the present invention.
Figure 12:
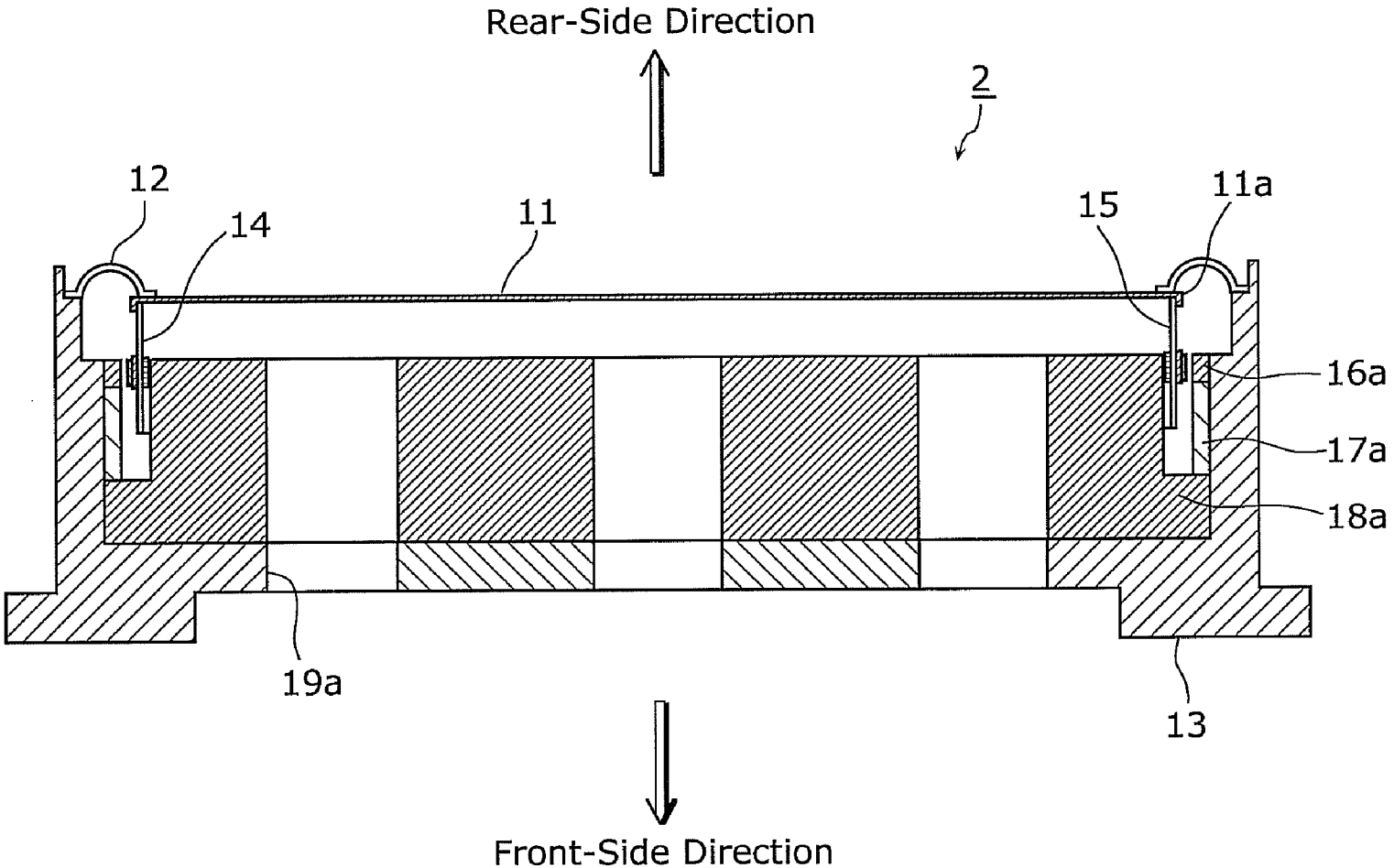
FIG. 12 is still another view of the speaker according to the variation of the first embodiment of the present invention.
Figure 13:
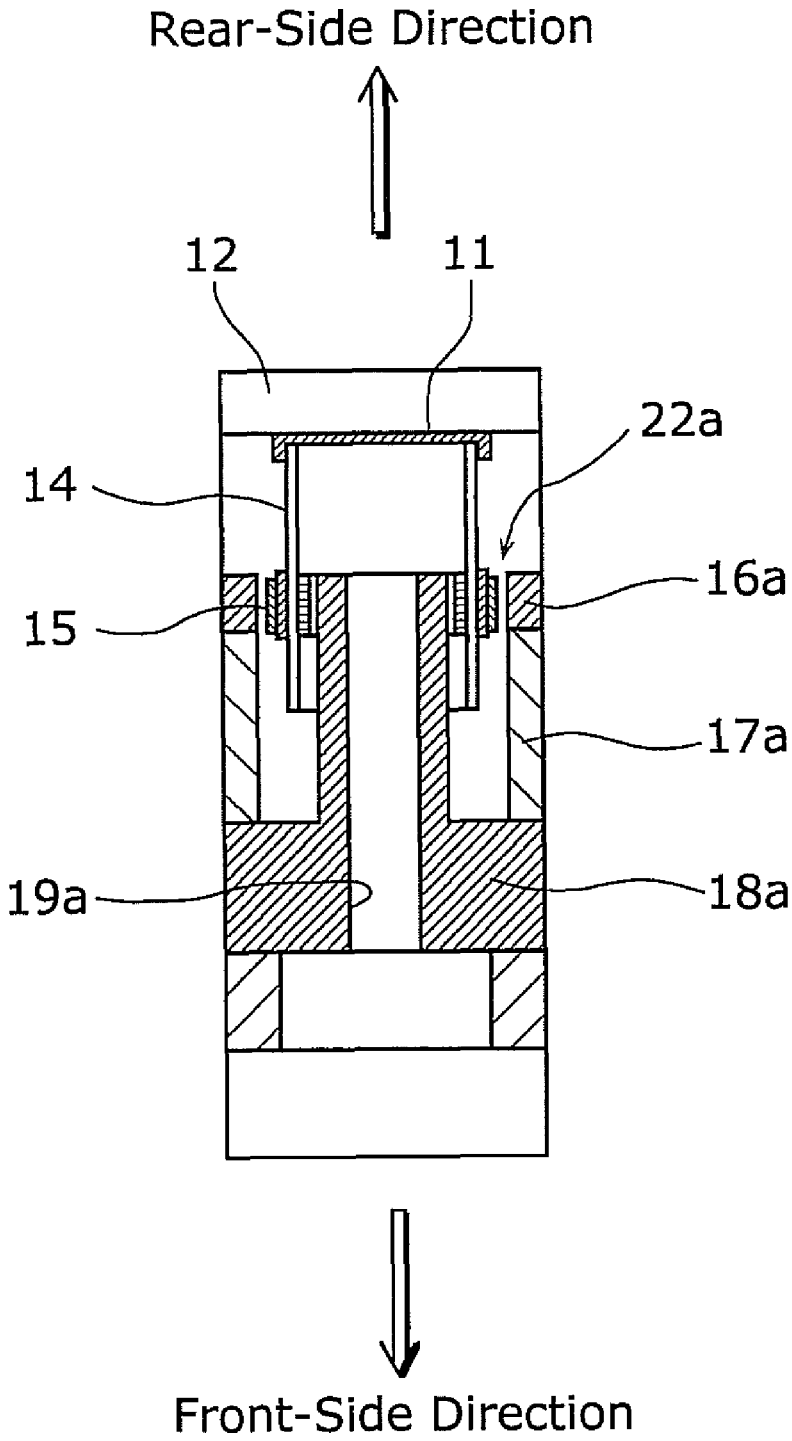
FIG. 13 is still another view of the speaker according to the variation of the first embodiment of the present invention.

FIGS. 10 to 13 are view of a speaker according to the variation of the first embodiment of the present invention. FIG. 10 is a perspective view of the speaker according to the variation of the first embodiment, placing a rear side of the speaker up (in other words, viewed from the rear-side direction). FIG. 11 is a perspective view of the speaker according to the variation of the first embodiment, placing a front side of the speaker up (in other words, viewed from the front-side direction). FIG. 12 is a cross-sectional view of the speaker taken along line A-a of FIG. 10. FIG. 13 is a cross-sectional view of the speaker taken along line B-b of FIG. 10. Same reference numerals in FIGS. 1 to 4 are assigned to the identical parts of FIGS. 10 to 13, so that explanation of the identical parts will not be repeated.

The speaker 2 shown in FIGS. 10 to 13 includes the diaphragm 11, the roll edges 12, the frame 13, the voice coil bobbin 14, the voice coil 15, and a magnetic circuit 21*a*. The magnetic circuit 21*a* includes a plate 16*a*, a magnet 17*a*, and a yoke 18*a*.

The magnetic circuit 21*a* is a circuit for driving the voice coil 15. In other words, the magnetic circuit 21*a* generates driving force for driving the voice coil 15. The magnetic circuit 21*a* has a long shape similar to the shape of the voice coil 15 (in this example, a slim and long shape). As shown in FIG. 13, the magnetic circuit 21*a* includes the plate 16*a*, the magnet 17*a*, the yoke 18*a*, through holes 19*a*, and a magnetic gap 22*a*. In addition, as shown in FIG. 13, the magnetic circuit 21*a* is an external magnet type magnetic circuit in which the magnet 17*a* is provided outside the yoke 18*a*.

The yoke 18*a* is a part to which the magnet 17*a* is adhered (fixed). A cross-sectional surface of the yoke 18*a* along the shorter-side direction has an inverted T shape. In other words, the yoke 18 has a convex at its center. Hereinafter, this convex is referred to as a center pole.

The magnet 17*a* is provided on the bottom of the yoke 18*a* to face external side surfaces of the convex (center pole) in the yoke 18*a*.

The plate 16*a* is provided to face the external side surface of the convex (center pole) in the yoke 18*a*, and is fixed (provided) on the top surface of the magnet 17*a*.

Each of the through holes 19*a* is formed to penetrate the convex (center pole) in the yoke 18*a* at the center. Thereby, the through holes 19*a* transmit sound generated by the diaphragm 11 towards the front surface of the speaker 2 (in the front-side direction).

The magnetic gap 22*a* is a gap between the plate 16*a* and the yoke 18*a*. In the magnetic gap 22*a*, magnetic flux is concentrated to occur. Likewise the magnetic gap 22, since the magnetic gap 22*a* has a shape similar to the shape of the voice coil 15, the magnetic gap 22*a* looks like two long lines along the longer-side direction, being viewed from the rear-side direction.

Furthermore, the magnetic gap 22*a* includes a magnetic gap internal space that is a gap between the inside walls of the voice coil bobbin 14 and the outer periphery surface of the center pole. In other words, the magnetic gap internal space is a gap between the inside walls of the voice coil bobbin 14 and the external surfaces of the center pole. Filling of magnetic fluid 20, which has property of being adsorbed by magnetic force, in the magnetic gap internal space blocks transmission of the sound generated by the diaphragm 11, between the inside and the outside of the energetic gap 22.

The magnetic fluid 20 is fluid having magnetic adsorptive property that is property of being adsorbed by magnetic force. The magnetic fluid 20 is filled (located) to occupy the magnetic gap internal space. Thereby, the magnetic fluid 20 blocks transmission of sound, which is generated by the diaphragm 11, in the space that is surrounded by the diaphragm 11 and the inside walls of the voice coil bobbin 14, except the through holes 19*a*. In other words, the magnetic fluid 20 blocks transmission of the sound generated by the diaphragm 11, between the inside and the outside of the space.

Second Embodiment

Although the first embodiment provides the structure where the diaphragm 11 is supported by the roll edges 12, the present invention is not limited to the structure. In the second embodiment of the present invention, the diaphragm 11 is supported by dampers in addition to the roll edges 12.

The following describes a speaker 3 according to the second embodiment of the present invention.

Figure 14:
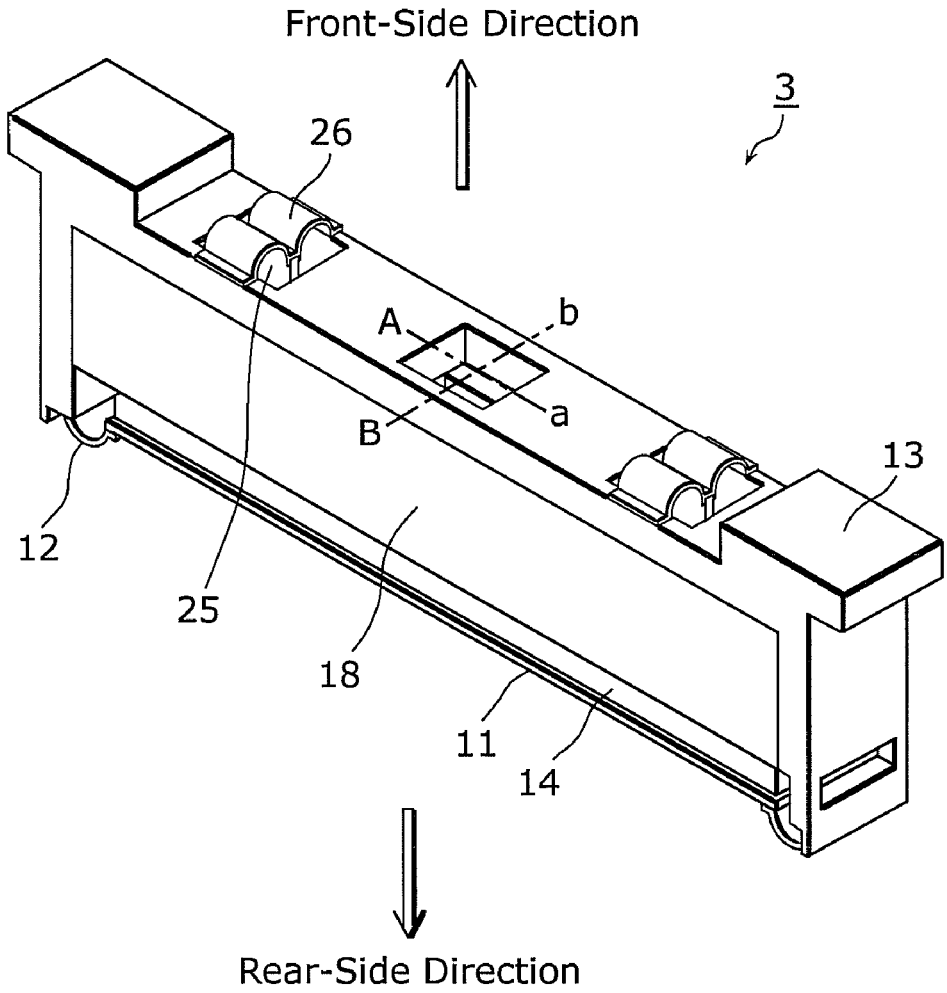
FIG. 14 is a view of a speaker according to a second embodiment of the present invention.
Figure 15:
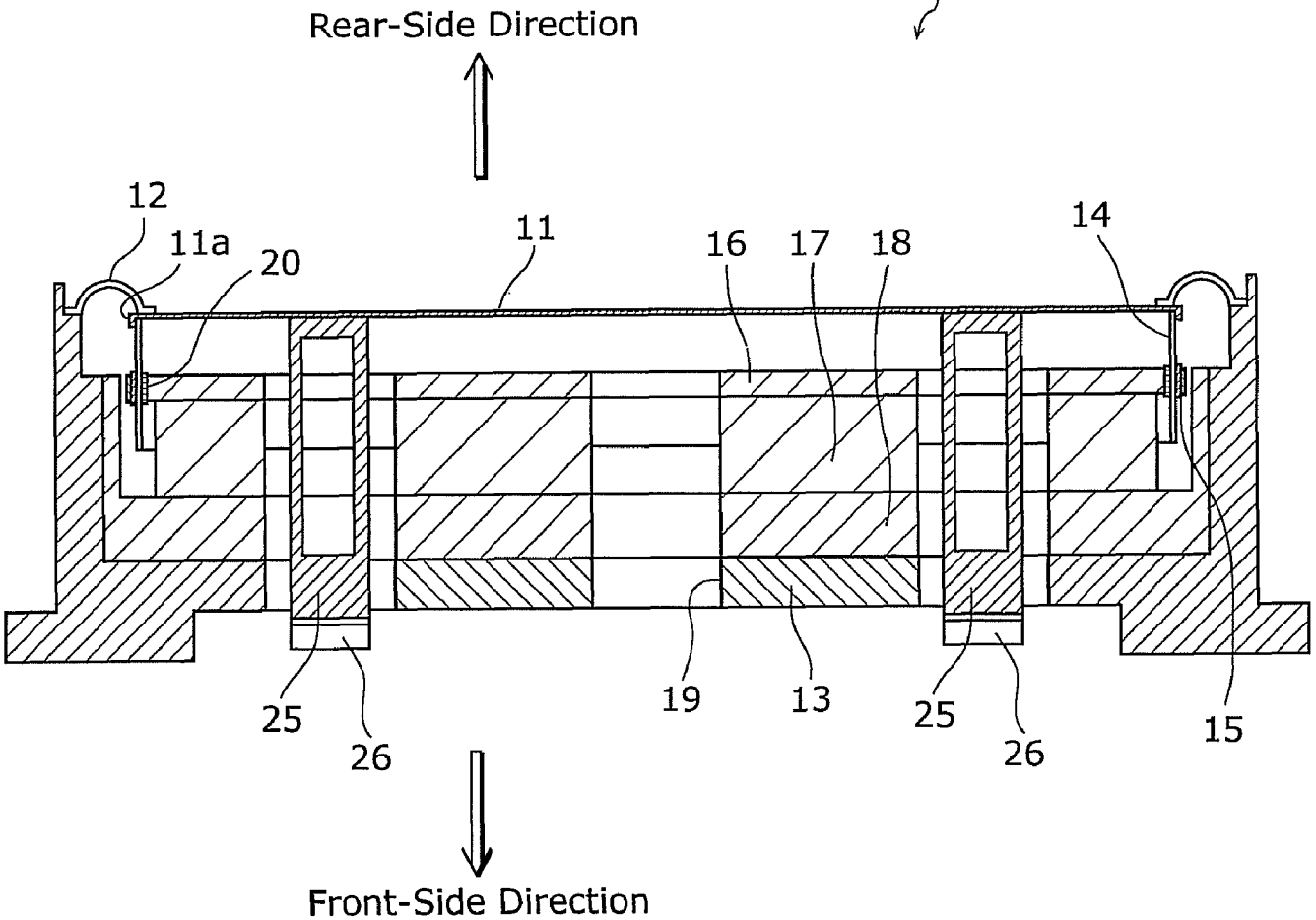
FIG. 15 is another view of the speaker according to the second embodiment of the present invention.
Figure 16:
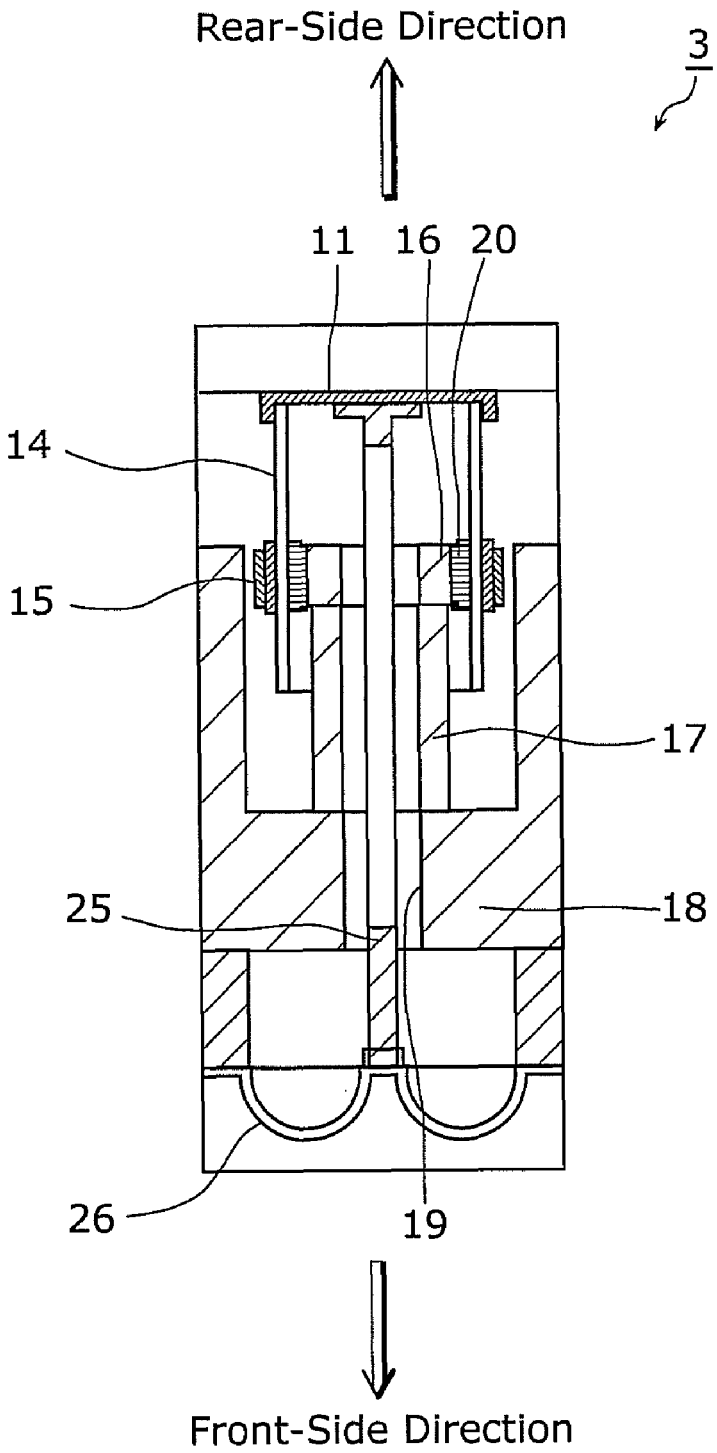
FIG. 16 is still another view of the speaker according to the second embodiment of the present invention.
Figure 17:
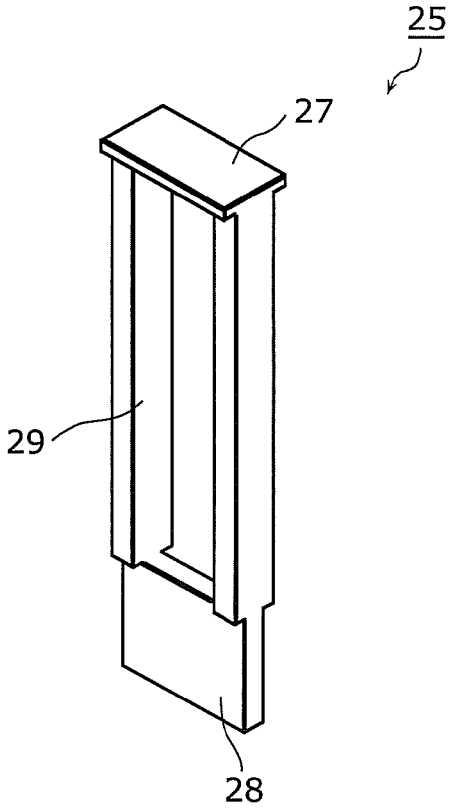
FIG. 17 is a view of a part included in the speaker according to the second embodiment of the present invention.
Figure 18:
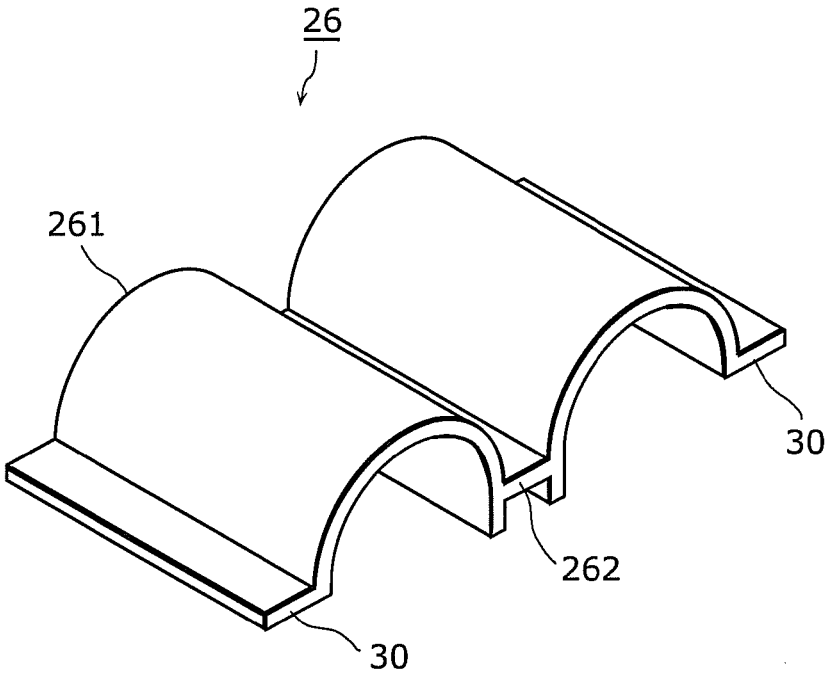
FIG. 18 is a view of a part included in the speaker according to the second embodiment of the present invention.

FIGS. 14 to 16 are view of the speaker 3 according to the second embodiment of the present invention. FIG. 14 is a perspective view of the speaker 3 according to the second embodiment, placing a front side of the speaker up (in other words, being viewed from the front-side direction). FIG. 15 is a cross-sectional view of the speaker taken along line A-a of FIG. 14. FIG. 16 is a cross-sectional view of the speaker taken along line B-b of FIG. 14. FIGS. 17 and 18 are views of respective parts included in the speaker 3 shown in FIG. 14. FIG. 17 shows a joint. FIG. 18 shows a damper. Same reference numerals in FIGS. 1 to 8 are assigned to the identical parts of FIGS. 14 to 16, so that explanation of the identical parts will not be repeated.

The speaker 3 according to the second embodiment shown in FIGS. 14 to 16 differs from the speaker 1 according to the first embodiment shown in FIGS. 1 to 8 in that joints 25 and dampers 26 are added. More specifically, the speaker 3 according to the second embodiment differs from the speaker 1 according to the first embodiment in the additional structure where each of the joints 25 is provided in a corresponding one of the through holes 19 to support a corresponding one of the dampers 26.

Each of the joints 25 has one end perpendicularly fixed to the diaphragm 11, so that, inside the through hole 19, the joint 25 joints the diaphragm 11 and an end of the damper 26.

More specifically, as shown in FIG. 17, each of the joints 25 includes a flat part 27 and a joint part 29. The flat part 27 is one end of the joint 25 and allows the end to be fixed to the diaphragm 11. The joint part 29 serves as a joint from the rear side of the diaphragm 11 to the front side of the speaker 3 (viewed from the front-side direction) through the through hole 19. At the end of the joint part 29, which is an end opposite to the flat part 27, there is a projection 28 jointed to the damper 26. As shown in FIG. 16, one end of the joint 25 is perpendicularly fixed to the front side of the diaphragm 11 (viewed from the front-side direction), namely, perpendicularly fixed to a surface of the diaphragm 11 which faces the through hole 19. With the above structure, the join 25 joints the diaphragm 11 and the damper 26 together through the through hole 19.

Each of the dampers 26 has one end connected to the other end of the joint 25, and the other end connected to the frame 13 of the speaker 3. More specifically, as shown in FIG. 18, each of the dampers 26 includes damper flat parts 30, two semicircular rolls 261, a joint region 262 between the two semicircular rolls 261.

The joint region 262 has a flat region having a certain area to be fixed with the projection 28. As shown in FIGS. 15 and 16, the projection 28 is fixed to the joint region 262.

The damper flat parts 30 are fixed to the frame 13.

The rolls 261 are formed by mold injection using foamed rubber material, solid rubber, or high-polymer material. Here, it is desirable to form the rolls 261 so that a top of each roll is thinner and a base of the roll is thicker. Furthermore, viewed from the front-side direction, a direction of positioning the rolls 261 of the damper 26 is perpendicular to a direction of positioning the rolls of the roll edge 12.

The joints 25 and the dampers 26 having the above-described structure as well as the roll edges 12 support the diaphragm 11. In other words, the voice coil 15 is supported through the diaphragm 11 by the frame 13 using the joints 25 and the dampers 26.

The following describes advantages of the speaker 3 having the above-described structure.

In the speaker 3 according to the second embodiment, the dampers 26 in addition to the roll edges 12 support the diaphragm 11. Thereby, the speaker 3 has a stronger support system than that of the speaker 1 according to the first embodiment. More specifically, the dampers 26 support the diaphragm 11 and the voice coil 15 via the joints 25 fixed to the diaphragm 11. Therefore, in the speaker 3, the vibration system (the diaphragm 11, the voice coil bobbin 14, and the voice coil 15) is supported by two kinds of supports which are the roll edges 12 and the dampers 26. As a result, the vibration system can produce stable vibration. In addition, the roll edges 12 and the dampers 26 are provided to the front side and the rear side of the diaphragm 11. Therefore, the center of gravity of the vibration system is located between the two kinds of the supports (the roll edges 12 and the dampers 26). Therefore, it is possible to provide the support system having a maximum distant between two support points. As a result, support of the vibration system is more stable. The above-described structure can prevent rolling phenomena and abnormal vibration of the vibration system even with a large amplitude. Therefore, it is possible to provide the speaker 3 with less distortion.

Furthermore, a direction of positioning the dampers 26 is orthogonal to a direction of positioning the roll edge 12. As a result, it is possible to provide a support system with drag both in the shorter-side direction and in the longer-side direction of the speaker 3.

As described above, the second embodiment of the present invention can provide the speaker 3 which has a long structure but is unlikely to cause breakeup resonance, and is thereby capable of having smooth frequency characteristics to offer good sound quality.

It should be noted that the joints 25 are not limited to the above. For example, joints 31 each of which is shorter than the joint 29 may be used. The example of using the joints 31 is described below.

Figure 19:
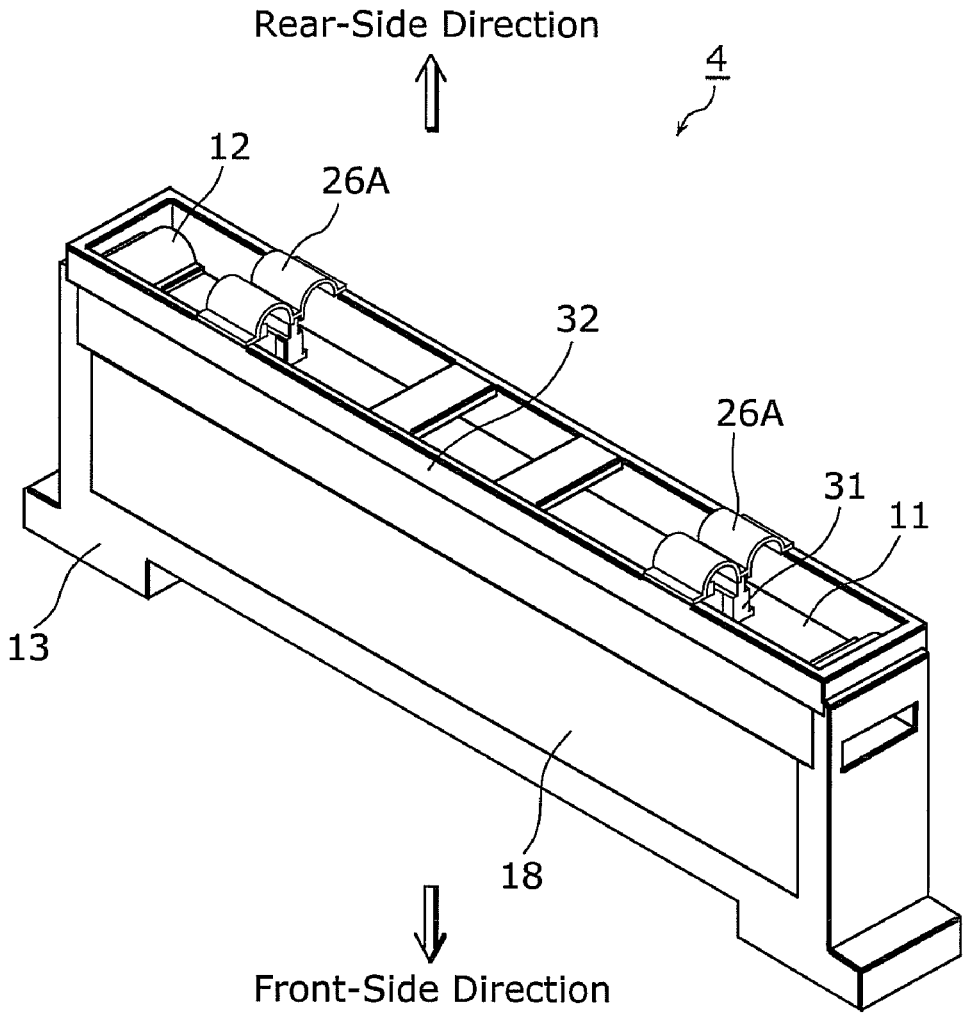
FIG. 19 is still another view of the speaker according to the variation of the second embodiment of the present invention.

FIG. 19 is a view of a speaker 4 according to a variation of the second embodiment of the present invention. FIG. 19 is a perspective view of the speaker according to the variation of the second embodiment, placing a rear side of the speaker up (in other words, viewed from the rear-side direction). Same reference numerals in FIGS. 1 to 8 are assigned to the identical parts of FIG. 19, so that explanation of the identical parts will not be repeated.

The speaker 4 according to the variation of the second embodiment which is shown in FIG. 19 differs from the speaker 3 according to the second embodiment in that the dampers 26 are replaced by the dampers 26A, the joints 25 are replaced by the joints 31, and an auxiliary frame 32 is included.

More specifically, the joints 31 are fixed (connected) to the diaphragm 11 on the rear side of the speaker 4, namely, on the side of the speaker 4 where the roll edges 12 are arranged. The auxiliary frame 32 is provided to the top of the frame 13 viewed from the rear-side direction of the speaker 4. The dampers 26A are fixed to the auxiliary frame 32 on the rear side of the speaker 4. More specifically, likewise the second embodiment, each of the dampers 26A includes the damper flat parts 30, the two semicircular rolls 261, and the joint region 262 between the two semicircular rolls 261. The joint region 262 is fixed to an end (the projection 28) of a corresponding one of the joints 31 which is opposite to the end fixed to the diaphragm 11. The damper flat parts 30 are fixed to the auxiliary frame 32.

As described above, the speaker 4 may have the support system including the dampers 26A, the joints 31, and the auxiliary frame 32. With the above structure, the dampers 26A and the roll edges 12 are arranged on the same side of the speaker 4. Therefore, in the assembly processes for the speaker 4, it is possible to arrange the dampers 26A after arranging the roll edges 12, without turning the speaker 4 back. As a result, the assembly processes can be simplified. Moreover, in the speaker 4, the joints 31 are not provided in the through holes 19. This structure can prevent blocking of the through holes 19 through which sound generated by the diaphragm 11 being transmitted. As a result, the speaker 4 according to the variation of the second embodiment can improve sound quality more than the speaker 3 according to the second embodiment.

Third Embodiment

It has been described in the first and second embodiments that the inside of the voice coil bobbin 14 is in a cuboidal shape. However, the shape of the voice coil bobbin 14 is not limited to the above. As described above, the voice coil 15 is wound around the external sides of the voice coil bobbin 14. Therefore, the dimensions of the inside of the voice coil bobbin 14 can be kept almost uniformly. However, since the voice coil bobbin 14 is in a shape of a thin sheet, there is a possibility that a width in the shorter-side direction is increased around the center in the longer-side direction by magnetic force or the like. The following describes a speaker according to the third embodiment of the present invention.

Figure 20:
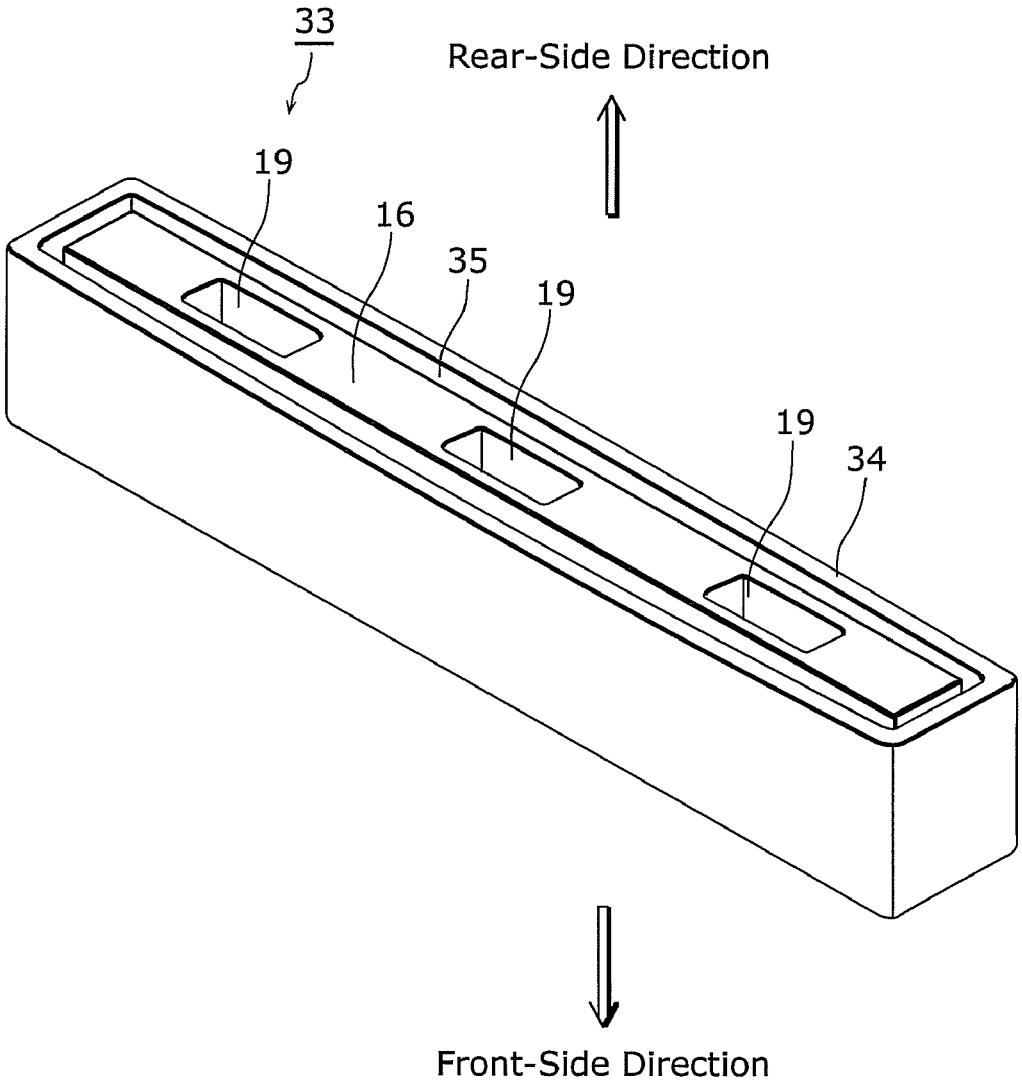
FIG. 20 is a perspective view of a magnetic circuit included in a speaker according to a third embodiment of the present invention.
Figure 21:
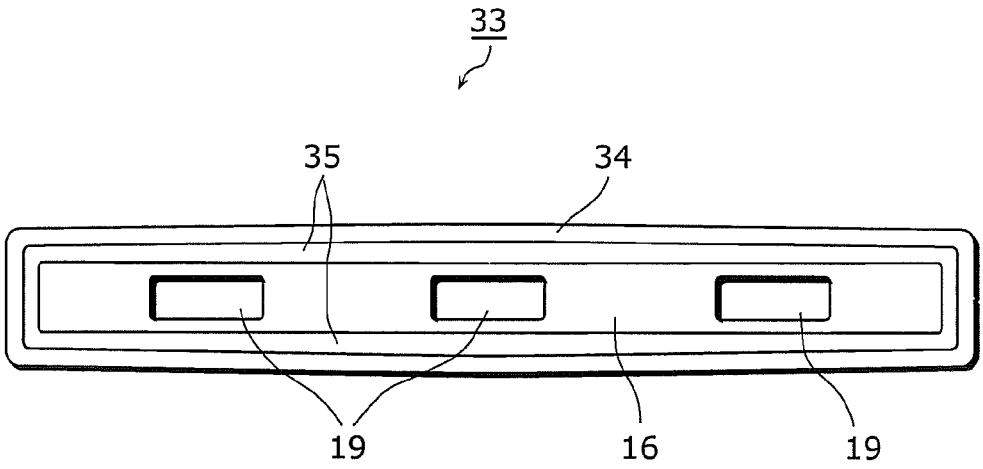
FIG. 21 is a plane view of the magnetic circuit included in the speaker according to the third embodiment of the present invention.
Figure 22:
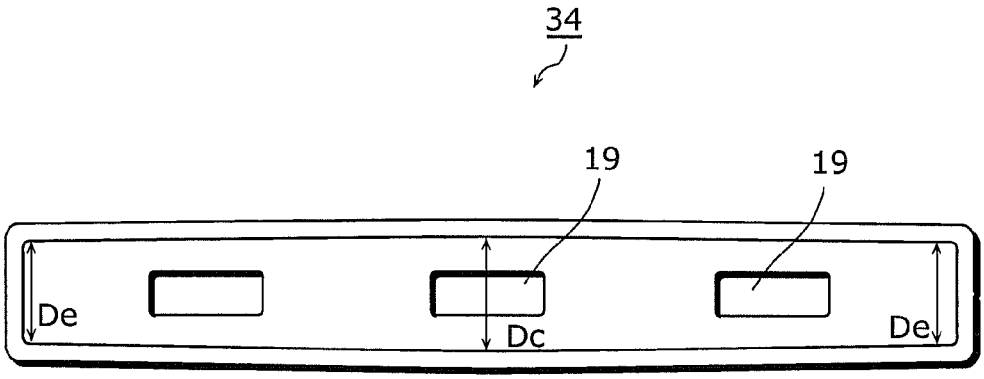
FIG. 22 is a plane view of a yoke 34 included in the speaker according to the third embodiment of the present invention.

FIG. 20 is a perspective view of a magnetic circuit included in the speaker according to the third embodiment of the present invention. FIG. 21 is a plane view of the magnetic circuit included in the speaker according to the third embodiment of the present invention. FIG. 22 is a plane view of a yoke 34 included in the speaker according to the third embodiment of the present invention. Same reference numerals in FIG. 8 are assigned to the identical parts of FIGS. 20 to 22, so that explanation of the identical parts will not be repeated.

Likewise the magnetic circuit 21 shown in FIG. 8, the magnetic circuit 33 shown in FIGS. 20 and 21 includes the plate 16, the magnet 17 (not shown), the through holes 19, a yoke 34, and a magnetic gap 35. The magnetic circuit 33 is an internal magnet type magnetic circuit in which the magnet 17 is provided inside the yoke 34.

The magnetic circuit 33 shown in FIG. 21 differs from the magnetic circuit 21 shown in FIG. 8 in that the yoke 34 is in a shape of a substantially arch. In more detail, regarding the yoke 34, a width along the shorter-side direction at the center viewed in the longer-side direction is greater than a width along the shorter-side direction at the end viewed in the longer-side direction.

The magnet 17 has one side fixed to the bottom of the cuboidal plate 16, and the other side fixed to the yoke 34.

The yoke 34 has a cross-sectional surface in a concave shape viewed in the shorter-side direction of the speaker. Being viewed from the rear-side direction of the speaker, each of the sides of the yoke 34 facing a corresponding one of the longer sides of plate 16 is in a shape of a substantially arch. Here, regarding the yoke 34, a width along the shorter-side direction at the center viewed in the longer-side direction is greater than a width along the shorter-side direction at the end viewed in the longer-side direction. Moreover, regarding the yoke 34, being viewed from the rear-side direction of the speaker, there is a gap surrounded by (a) the longer side of the plate 16 and (b) the longer side of the yoke 34 facing the longer side of the plate 16. The gap includes the magnetic gap 35. More specifically, as shown in FIG. 22, regarding the yoke 34, each of the longer sides is in a shape of a gentle arch. Here, a distance Dc along the shorter-side direction at the center viewed in the longer-side direction is greater than a distance De along the shorter-side direction at the end viewed in the longer-side direction.

The magnetic gap 35 is a gap between the plate 16 and the yoke 34. The magnetic gap 35 includes a magnetic gap internal space that is provided in a gap between the plate 16 and inside walls of the concave of the yoke 34. In the magnetic gap 35, magnetic flux is concentrated to occur. Regarding the magnetic gap 35 in the above structure, since the plate 16 is in a cuboidal shape and the yoke 34 is in a shape of an arch, a width along the shorter-side direction at the center viewed in the longer-side direction is greater than a width along the shorter-side direction at the end viewed in the longer-side direction, as shown in FIG. 21.

The speaker according to the third embodiment of the present invention has the above-described structure.

The following describes advantages of the speaker having the above-described structure.

Here, the vibration system of the speaker according to the third embodiment is described. First, current is applied to the voice coil 15. Thereby, driving force occurs in the voice coil 15 by the applied current and a magnetic field caused by the magnetic circuit 33. The driving force allows the diaphragm 11 to vibrate via the voice coil bobbin 14. More specifically, the voice coil 15 causes the diaphragm 11 to vibrate by the generated driving force. Sound occurs by the vibration of the diaphragm 11, and is emitted to the open space.

Subsequently, the magnetic fluid 20 generates internal pressure to prevent the voice coil bobbin 14 from being in contact with the plate 16. The voice coil bobbin 14, which is long and a substantially square pillar in shape, is inflated outwards by the internal pressure and is thereby displaced. As a result, the center of the voice coil bobbin 14 is the most inflated portion.

The magnetic circuit 21 in the speakers according to the first and second embodiments has the magnetic gap 22 that is linear in shape. Therefore, in the magnetic circuit 21, the entire periphery of the magnetic gap 22 is long. On the other hand, in the magnetic circuit 33 in the speaker according to the third embodiment, the internal surface of the yoke 34 is in a shape of an arch. Thereby, the magnetic circuit 33 includes the magnetic gap 35. Here, regarding the magnetic gap 35, a width at the center viewed in the longer-side direction is greater than a width at the end viewed in the longer-side direction. In other words, in the magnetic circuit 33 according to the third embodiment, in consideration of the inflation (deformation amount) at the center in the longer-side direction of the voice coil bobbin 14, the magnetic gap 35 corresponds to the deformation amount, without increasing the width along the shorter-side direction.

The above structure offers advantages of preventing the decrease of magnetic flux density, thereby providing a speaker with high sound pressure level.

As described above, the third embodiment of the present invention can provide the speaker which has a long structure but is unlikely to cause breakeup resonance, and is thereby capable of having smooth frequency characteristics to offer good sound quality.

It should be noted that it has been described above that the inside walls of the yoke 34 is in a shape of an arch, but the structure of the yoke 34 is not limited to the above. For example, the yoke 34 may have longer sides each of which forms an isosceles triangle. More specifically, a part of each longer side from the end to the center of the longer side is a straight line.

It should also be noted that it has been described in the third embodiment that the magnetic circuit 33 is an internal magnet type magnetic circuit in which the magnet 17 is provided inside the yoke 34. However, the magnetic circuit 33 is not limited to the above. The magnetic circuit 33 may be an external magnet type magnetic circuit in which the magnet 17 is outside the yoke 34. In the case of the external magnet type magnetic circuit, regarding the plate 16*a* shown in FIGS. 10 to 13, it is preferable that each of the longer sides facing the center pole is in a shape of a substantially arch, being viewed from the rear-side direction of the speaker (looking at the rear side of the speaker). Here, regarding the plate 16*a*, it is preferable that a width along the shorter-side direction at the center of the plate 16*a* viewed in the long-side direction is greater than a width along the shorter-side direction at the end of the plate 16*a* viewed in the longer-side direction.

With the above structure, it is possible to provide the speaker which has a long structure but is unlikely to cause breakeup resonance, and is thereby capable of having smooth frequency characteristics to offer good sound quality.

Figure 23:
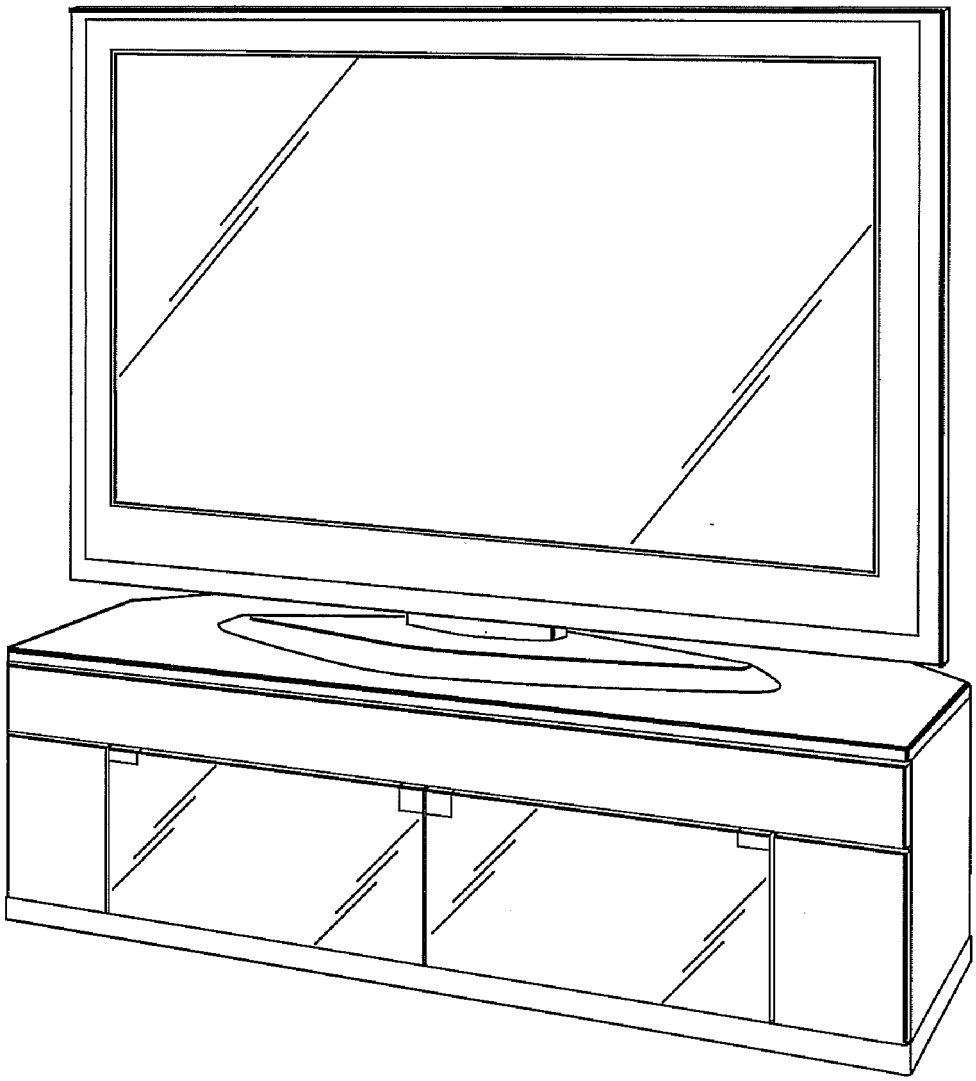
FIG. 23 is a view of an example of a display apparatus including the speaker according to any one of the embodiments of the present invention.
Figure 24A:
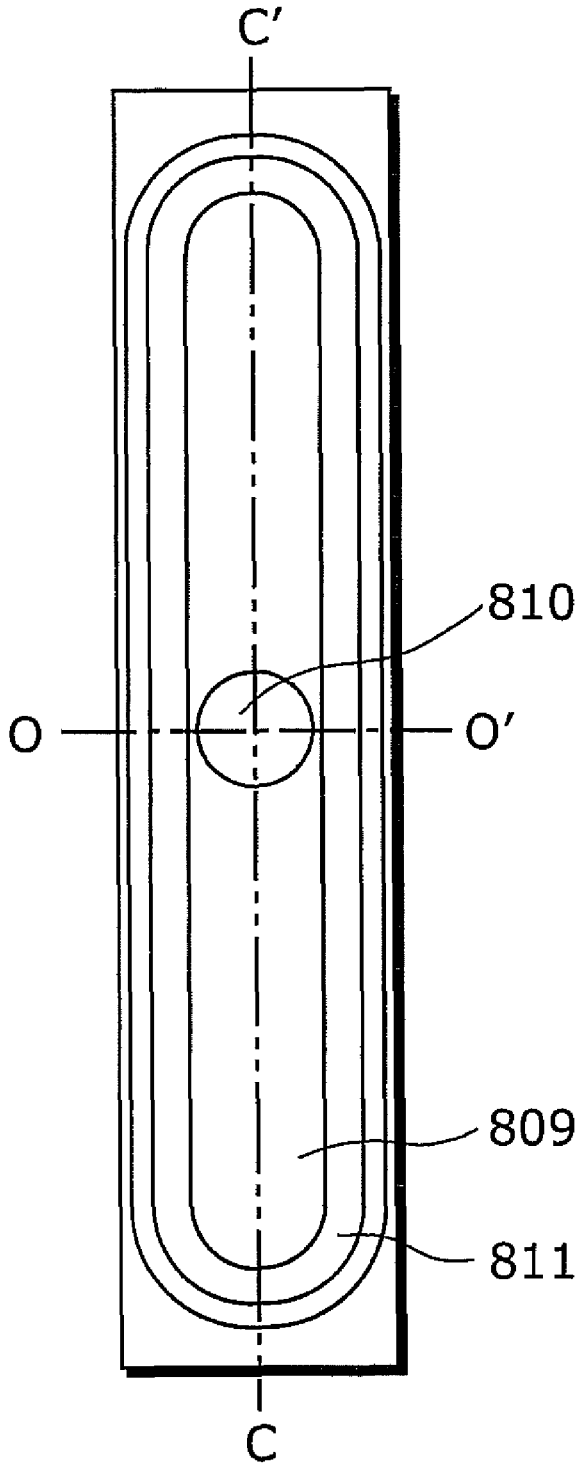
FIG. 24A is a view of the conventional slim speaker disclosed in Patent Reference 1.
Figure 24B:
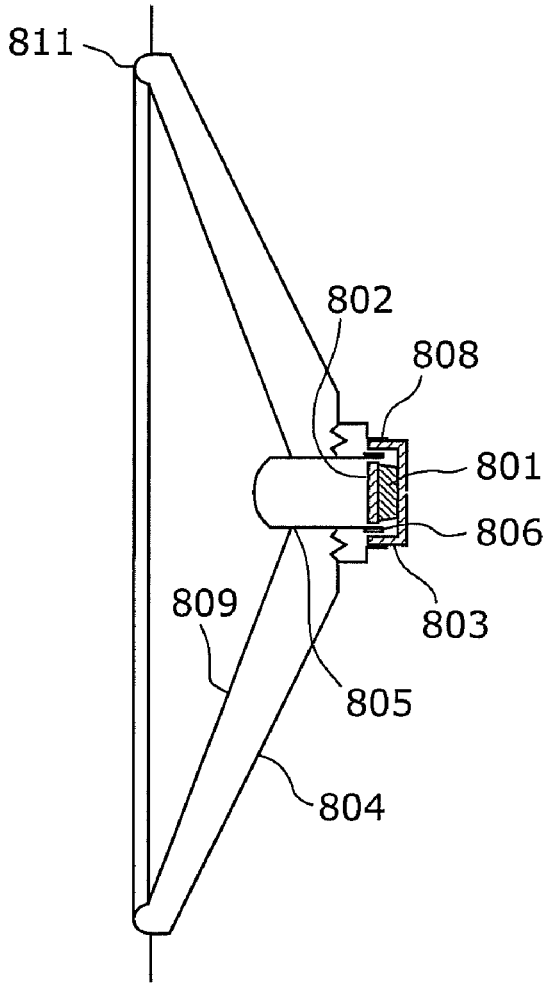
FIG. 24B is another view of the conventional slim speaker.
Figure 24C:
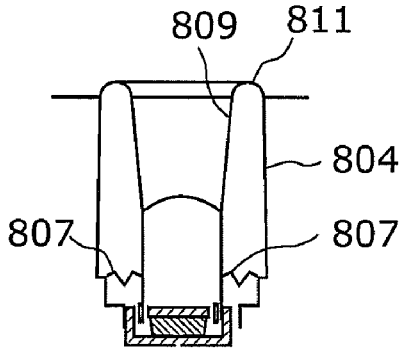
FIG. 24C is still another view of the conventional slim speaker.
Figure 25:
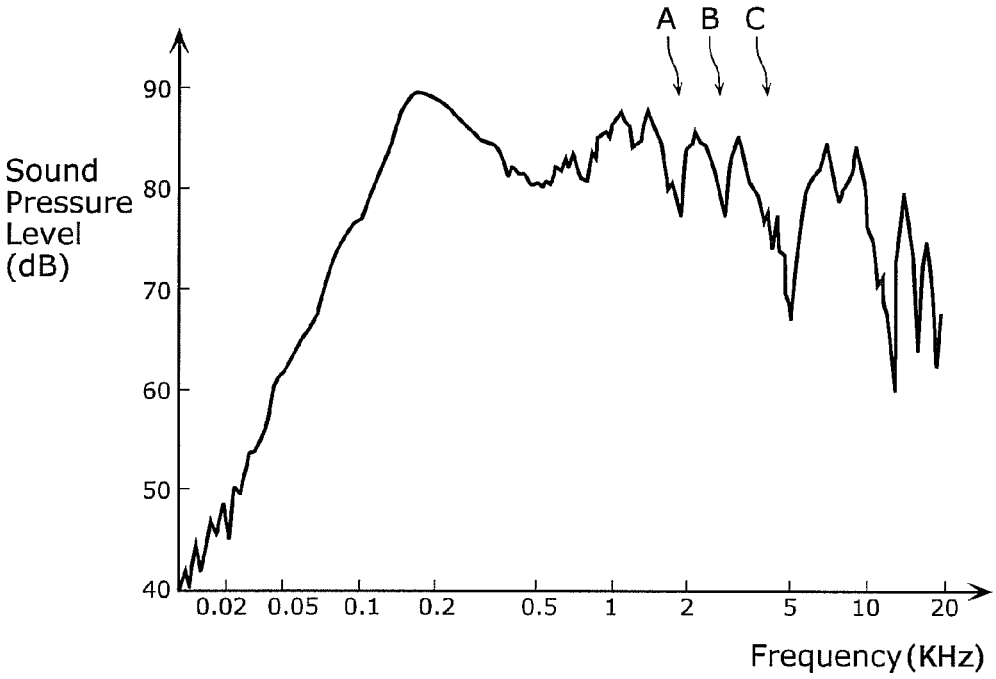
FIG. 25 is a graph plotting frequency characteristics regarding a reproduction sound pressure level of the conventional slim speaker.

It should also be noted that the speaker according to the present invention is easily manufactured to be slim and thin, so that the speaker can be used in electronic devices such as a thin-screen television set as shown in FIG. 23, a mobile telephone, and a Personal Digital Assistance (PDA). In other words, the electronic device includes: the speaker according to the present invention; and a case storing the speaker.

Although the speakers and electronic devices including such speakers according to only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of this invention.

INDUSTRIAL APPLICABILITY

The present invention can be used as a speaker which has a long structure but is capable of producing a large amplitude to reproduce sound with lower frequency. In addition, the present invention can be used as an electronic device including the speaker.

What is claimed is:

1. A speaker comprising:

a diaphragm that is a long flat plate;

an edge disposed at an end of said diaphragm viewed in a longer-side direction of said speaker, said edge supporting said diaphragm to allow said diaphragm to vibrate;

at least one voice coil bobbin in a shape of a substantially square pillar having a height that is equal to or more than twice as a vibrational amplitude of said diaphragm, said at least one voice coil bobbin including an opening having a periphery connected directly to said diaphragm, and said at least one voice coil bobbin supporting said diaphragm to transmit vibration to said diaphragm;

a voice coil wound around an outer periphery of said at least one voice coil bobbin substantially at center in a height direction of said at least one voice coil bobbin; and a magnetic circuit arranged to drive said voice coil.

2. The speaker according to claim 1, wherein said magnetic circuit is an internal magnet type magnetic circuit, said magnetic circuit including:

a yoke having a concave at center of said yoke;

a magnet disposed on a bottom of said concave of said yoke;

a plate in a cuboidal shape, said plate disposed in said concave of said yoke and fixed on a top surface of said magnet;

a through hole penetrating said plate, said magnet, and said yoke at center of said plate, said magnet, and said yoke;

a magnetic gap internal space surrounded by (a) inside walls of said at least one voice coil bobbin and (b) an outer periphery surface of said plate; and a magnetic fluid that is liquid having property of being adsorbed by magnetic force, said magnetic fluid filling said magnetic gap internal space, wherein said magnetic fluid blocks transmission of sound in a space except said through hole, the sound being generated by said diaphragm, and the space being surrounded by said diaphragm and said at least one voice coil bobbin.

3. The speaker according to claim 2, wherein said yoke has a cross-sectional surface in a shape of a concave viewed in a shorter-side direction of said speaker, said yoke has sides each in a shape of a substantially arch facing a corresponding one of longer sides of said plate viewed in a rear-side direction of said speaker, and said yoke has a width along the shorter-side direction at center of said yoke viewed in the longer-side direction is greater than a width along the shorter-side direction at an end of said yoke viewed in the longer-side direction, and said yoke includes a magnetic gap including said magnetic gap internal space, said magnetic gap being surrounded by (a) the longer sides of said plate and (b) the sides of said yoke each facing the corresponding one of the longer sides of said plate.

4. The speaker according to claim 1, wherein said magnetic circuit is an external magnet type magnetic circuit, said magnetic circuit comprising:

a yoke in an inverted T shape, said yoke having a center pole;

a magnet disposed outside said center pole;

a plate disposed outside said center pole and fixed on a top surface of said magnet;

a though hole penetrating said center pole at center;

a magnetic gap internal space that is a gap between (a) inside walls of said at least one voice coil bobbin and (b) an outer periphery surface of said center pole; and a magnetic fluid that is liquid having property of being adsorbed by magnetic force, said magnetic fluid filling said magnetic gap internal space, wherein said magnetic fluid blocks transmission of sound in a space except said through hole, the sound being generated by said diaphragm, and the space being surrounded by said diaphragm and said at least one voice coil bobbin.

5. The speaker according to claim 4, wherein, being viewed from a rear-side direction of said speaker, said plate has a longer side facing said center pole, the longer side being in a shape of a substantial arch, and a width along a shorter-side direction of said speaker at center of said plate viewed in the longer-side direction is greater than a width along the shorter-side direction at an end of said plate viewed in the longer-side direction.

6. The speaker according to claim 2, wherein said diaphragm is substantially plane in a shape having a surface with a plurality of reinforcement ribs, the reinforcement ribs being a series of convexes and concaves arranged in the longer-side direction.

7. The speaker according to claim 2, wherein said edge is in a shape of a roll having a top and a base, the top being thinner than the base, and the roll having a thickness getting thicker from the top to the base.

8. The speaker according to claim 1, wherein said diaphragm has a longer side and a shorter side, wherein a length of the shorter side is 0.5 or less assuming that a length of the longer side is 1.

9. The speaker according to claim 1, further comprising a joint having one end perpendicularly connected to said diaphragm; and a damper having (a) one end connected to an other end of said joint, and (b) an other end connected to a frame of said speaker, wherein said voice coil is supported by the frame using said joint and said damper via said diaphragm.

10. The speaker according to claim 9, wherein, inside said through hole, said joint joints said diaphragm and the one end.

11. An electronic device comprising a speaker including:

a diaphragm that is a long flat plate;

an edge disposed at an end of said diaphragm viewed in a longer-side direction of said speaker, said edge supporting said diaphragm to allow said diaphragm to vibrate;

at least one voice coil bobbin in a shape of a substantially square pillar having a height that is equal to or more than twice as a vibrational amplitude of said diaphragm, said at least one voice coil bobbin including an opening having a periphery connected to said diaphragm, and said at least one voice coil bobbin supporting said diaphragm to transmit vibration to said diaphragm;

a voice coil wound around an outer periphery of said at least one voice coil bobbin substantially at center in a height direction of said at least one voice coil bobbin; and a magnetic circuit arranged to drive said voice coil.

* * * * *